US005482826A

United States Patent [19]

Okamura et al.

[11] Patent Number: 5,482,826

[45] Date of Patent: Jan. 9, 1996

[54] METHOD FOR FORMING SILVER HALIDE GRAINS AND A METHOD FOR PRODUCING A SILVER HALIDE PHOTOGRAPHIC MATERIAL

[75] Inventors: Hisashi Okamura; Hiroshi Kawamoto; Makoto Kikuchi, all of Minami-ashigara, Japan

[73] Assignee: Fuji Photo Film Co., Ltd., Kanagawa, Japan

[21] Appl. No.: 197,181

[22] Filed: Feb. 16, 1994

[30] Foreign Application Priority Data

Feb. 16, 1993 [JP] Japan ..... 5-048695
Feb. 25, 1993 [JP] Japan ..... 5-059419

[51] Int. Cl.[6] ..... G03C 1/015

[52] U.S. Cl. ..... 430/569; 430/567

[58] Field of Search ..... 430/567, 569

[56] References Cited

U.S. PATENT DOCUMENTS 5,389,508 2/1995 Takada et al. ..... 430/569
5,418,124 5/1995 Suga et al. ..... 430/567

FOREIGN PATENT DOCUMENTS 2-68538 3/1990 Japan .

OTHER PUBLICATIONS

English translation of JP2–68,538.

*Primary Examiner*—Charles L. Bowers, Jr.
*Assistant Examiner*—Mark F. Huff
*Attorney, Agent, or Firm*—Birch, Stewart, Kolasch & Birch

[57] ABSTRACT

There is disclosed a method for forming silver halide grains and a method for processing a silver halide photographic material using the same. The method for forming silver halide grains comprises using at least one iodide-ion-releasing compound represented by the following formula (I) or (II):

$$I—L—So_3^-M^+ \qquad \text{formula (I)}$$

wherein L represents a divalent organic group and $M^+$ represents a hydrogen ion or a monovalent cation, formula (II)

wherein L represents a divalent organic group, $R^1$ and $R^2$, which are the same or different, each represent a hydrogen atom, an alkyl group, an aralkyl group, or an aryl group, which groups may be substituted, and $R^1$ and $R^2$ may bond together to form a ring.

25 Claims, No Drawings

METHOD FOR FORMING SILVER HALIDE GRAINS AND A METHOD FOR PRODUCING A SILVER HALIDE PHOTOGRAPHIC MATERIAL

FIELD OF THE INVENTION

The present invention relates to a method for forming silver halide grains; more particularly to a method for forming silver halide grains for photographic emulsions that are low in fogging and high in sensitivity and are improved in abrasion-and-pressure resistance, and to a method for producing silver halide photographic materials using the same.

BACKGROUND OF THE INVENTION

In recent years, the demand for the performance of photographic silver halide emulsions has become severe; in particular with respect to toughness, such as abrasion-and-pressure resistance, in audition to such photographic properties as high sensitivity and excellent graininess, a further high level is demanded.

It is considered preferable that, in order to make silver halide grains highly sensitive and to improve the abrasion-and-pressure resistance, the silver iodide (iodide ions) content should be uniform from grain to grain, with a view to effecting uniform chemical sensitization.

Conventionally, when a silver halide phase containing silver iodide is formed in a step of forming silver halide grains, the following methods for supplying iodide ions are used: a method wherein an aqueous iodide solution, such as an aqueous KI solution, is used; and a method disclosed in JP-A ("JP-A" means unexamined published Japanese patent application) No. 68538/1990, wherein silver halide fine grains containing silver iodide or an iodide-releasing compound is used.

However, in the method wherein an aqueous iodide solution is used, by adding iodide ions in the free state into a reaction solution, a nonuniform region is produced in which the concentration distribution of iodide ions is nonuniform. Therefore, uniform growth of grains cannot take place from grain to grain.

On the other hand, the technique disclosed in the above-mentioned patent application is a technique wherein iodide ions are released slowly to grow grains uniformly without a change in the halogen composition (the microscopical distribution of silver iodide) in the grains and from grain so grain. However, even when silver halide grains are formed by using the exemplified compounds of iodide-ion-releasing compounds described in the above-mentioned patent application, the method does not satisfactory meek the demand for lowering of fogging, high sensitivity, and improvement in abrasion-and-pressure resistance.

SUMMARY OF THE INVENTION

An object of the present invention is to make the distribution of silver iodide in silver halide grains uniform from grain to grain.

Another object of the present invention is to provide a silver halide emulsion that is low in fogging and is improved in sensitivity and abrasion-and-pressure resistance.

A still further object of the present invention is to provide a process for producing a silver halide photographic material that is low in fogging and improved in sensitivity and abrasion-and-pressure resistance.

The above and other objects, features, and advantages of the invention will be apparent more fully from the following description.

DETAILED DESCRIPTION OF THE INVENTION

The above objects have been achieved by the following.

(1) A method for forming silver halide grains, which comprises using at least one iodide-ion-releasing compound represented by the following formula (I) or (II):

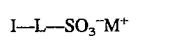

formula (I)

wherein L represents a divalent organic group and $M^+$ represents a hydrogen ion or a monovalent cation,

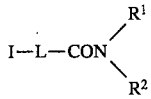

formula (II)

wherein L represents a divalent organic group, $R^1$ and $R^2$, which are the same or different, each represent a hydrogen atom, an alkyl group, an aralkyl group, or an aryl group, which groups may be substituted, and $R^1$ and $R^2$ may bond together to form a ring, (2) The method for forming silver halide grains as stated in the above (1), wherein the iodide-ion-releasing compound is represented by the following formula (I):

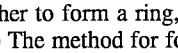

formula (I)

wherein L represents a divalent organic group and $M^+$ represents a hydrogen ion or a monovalent cation, (3) The method for forming silver halide grains as stated in the above (1), wherein the iodide-ion-releasing compound is represented by the following formula (II):

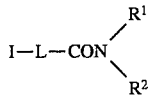

formula (II)

wherein L represents a divalent organic group, $R^1$ and $R^2$, which are the same or different each represent a hydrogen atom, an alkyl group, an aralkyl group, or an aryl group, which groups may be substituted, and $R^1$ and $R^2$ may bond together to form a ring, (4) The method for forming silver halide grains as stated in the above (1), wherein the silver halide grains contain silver iodide and have a high-silver-iodide region therein, the region's silver iodide content is higher than the average silver iodide content of the whole silver halide grain, and the high-silver-iodide region is formed by using an iodide-ion-releasing compound represented by the above formula (I) or (II).

(5) The method for forming silver halide grains as stated in the above (1) or (4), wherein the iodide-ion-releasing compound is used in the presence of an iodide-ion-release regulator.

(6) The method for forming silver halide grains as stated in the above (1), wherein silver halide grains are formed whose deviation coefficient of the silver iodide content distribution is 3 to 20%.

(7) A method for producing a silver halide photographic material, which comprises forming silver halide grains in the presence of at least one iodide-ion-releasing compound represented by the following formula (I) or (II) and coating an emulsion containing the silver halide grains as at least one silver halide emulsion layer on a support:

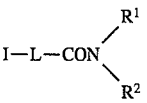

formula (I)

wherein L represents a divalent organic group and $M^+$ represents a hydrogen ion or a monovalent cation, formula (II)

wherein L represents a divalent organic group, $R^1$ and $R^2$, which are the same or different each represent a hydrogen atom, an alkyl group, an aralkyl group, or an aryl group, which groups may be substituted, and $R^1$ and $R^2$ may bond together to form a ring.

(8) The method for producing a silver halide photographic material as stated in the above (7), wherein silver halide grains are formed in the presence of at least one iodide-ion-releasing compound represented by the following formula (I) and an emulsion containing the silver halide grains is coated as at least one silver halide emulsion layer on a support:

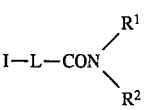

formula (I)

wherein L represents a divalent organic group and $M^+$ represents a hydrogen ion or a monovalent cation, (9) The method for producing a silver halide photographic material as stated in the above (7), wherein silver halide grains are formed in the presence of at least one iodide-ion-releasing compound represented by the following formula (II) and an emulsion containing the silver halide grains is coated as at least one silver halide emulsion layer on a support:

formula (II)

wherein L represents a divalent organic group, $R^1$ and $R^2$, which are the same or different, each represent a hydrogen atom, an alkyl group, an aralkyl group, or an aryl group, which groups may be substituted, and $R^1$ and $R^2$ may bond together to form a ring.

The present invention now will be described in more detail below.

The iodide-ion-releasing compound represented by formula (I) or (II) of the present invention is a compound that releases an iodide ion by a reaction with a base and/or a nucleophilic reagent, for example, by a substitution reaction, by an elimination reaction, or by a hydrolysis reaction.

The divalent organic group represented by L in formula (I) or (II) includes an aliphatic group, an aromatic group, and a heterocyclic group; a group formed by a combination thereof; and a group formed by combining these groups with —O—, —N(R)—, —CO—, —CS—, —S—, —SO—, —$SO_2$—, —P(R)—, or —PO(R)—, in which group R represents a hydrogen atom or a monovalent group.

The aliphatic group included in L may be saturated or unsaturated and is preferably one having 1 to 30 carbon atoms, and particularly preferably it is a straight-chain, branched-chain, or cyclic alkylene group having 1 to 20 carbon atoms, preferably 1 to 8 carbon atoms, more preferably 1 to 4 carbon atoms. Concretely, the aromatic group included in L is preferably a monocyclic or bicyclic aryl group, which may be condensed with another heterocyclic ring. The heterocyclic group included in L may be saturated or unsaturated and is preferably a 5- or 6-membered ring containing one or more of N, O, P, S, and Se, more preferably a 5- or 6-membered heterocyclic group containing at least one of N, O, or S, with particular preference given to a 5- or 6-membered nitrogen-containing heteroaromatic ring, typical examples being a pyridine ring, a pyridazine ring, a pyrimidine ring, a pyradine ring, a triazine ring, an imidazole ring, an oxazole ring, and a thiazole ring, and a benzo-condensed ring of these.

The divalent group represented by L in formula (I) or (II) may be substituted and typical examples of the substituent include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group, and an imido group. Preferable substituents are an alkyl group (preferably having 1 to 20 carbon atoms), an aralkyl group (preferably having 7 to 30 carbon atoms), an alkoxy group (preferably having 1 to 20 carbon atoms), a substituted amino group (preferably an amino group substituted by an alkyl group having 1 to 20 carbon atoms), an acylamino group (preferably having 2 to 30 carbon atoms), a sulfonamido group (preferably having 1 to 30 carbon atoms), a ureido group (preferably having 1 to 30 carbon atoms), and a phosphoric acid amido group (preferably 1 to 30 carbon atoms), which may be substituted.

The iodine atom represented by I in formula (I) or (II) is preferably bonded to a carbon atom of the divalent organic group represented by L, and particularly preferably I is bonded to the part of an aliphatic group contained in L. If I is bonded to the part of an aromatic group of L, preferably the aromatic group is a benzene ring (inclusive of a fused ring) and the ortho position or the para position relative to I has an electron-attracting substituent, such as a cyano group, a nitro group, or a sulfonyl group. If I is bonded to the part of a heterocyclic group of L, preferably the heterocyclic ring is a 5- or 6-membered nitrogen-containing heterocyclic aromatic ring (inclusive of a condensed ring) and I is bonded to the carbon atom adjacent to the nitrogen atom on the heterocyclic aromatic ring or is positioned on the carbon atom that is the third atom from the nitrogen atom on the heterocyclic aromatic ring.

The cation represented by $M^+$ in formula (I) is a hydrogen ion or a monovalent cation. Preferably the cation is, for example, a substituted or unsubstituted ammonium ion, an alkali metal ion (e.g., $Na^+$, $K^+$, and $Li^+$), or another metal ion (e.g., ½ $Mg^{2+}$ and ½ $Ca^{2+}$).

In formula (II), $R^1$ and $R^2$, which are the same or different, each represent a hydrogen atom, a straight-chain, branched-chain, or a cyclic alkyl group having 1 to 20 carbon atoms, preferably having 1 to 8 carbon atoms (e.g., methyl, ethyl, isopropyl, butyl, 2-ethylhexyl, and cyclohexyl), an aralkyl group having 7 to 20 carbon atoms (e.g., benzyl and phenethyl), or an aryl group having 6 to 20 carbon atoms (e.g., phenyl and naphthyl), wherein $R^1$ and $R^2$ may be substituted by the substituent, for example, such a substituent as mentioned for L, and $R^1$ and $R^2$ may bond together to form a ring, preferably 5- or 6-membered ring (e.g., pyrrolidine ring and piperidine ring).

Particularly preferable $R^1$ or $R^2$ is a hydrogen atom.

Specific examples of the compound represented by the above formula (I) are shown below, but the present invention is not restricted to them.

I-1

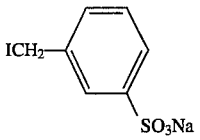

I-2

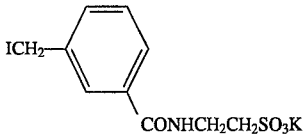

I-3

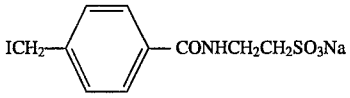

I-4

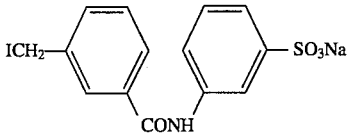

I-5

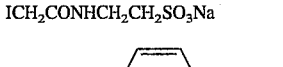

I-6

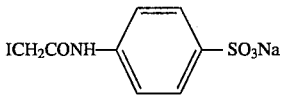

I-7

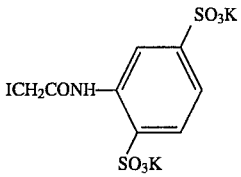

I-8

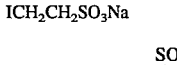

I-9

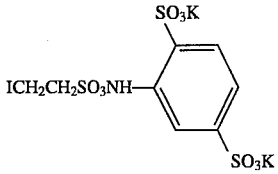

I-10

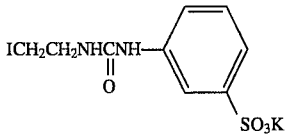

I-11

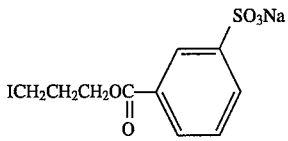

-continued

I-12

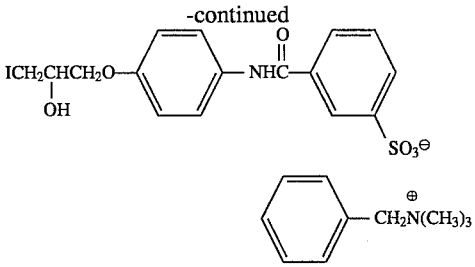

I-13

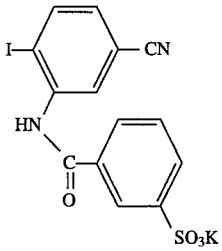

I-14

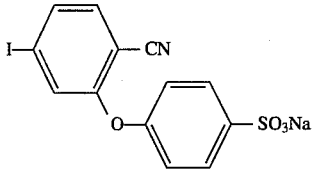

I-15

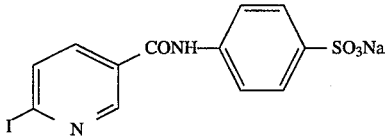

I-16

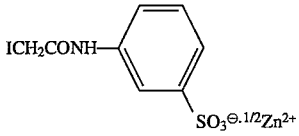

Specific examples of the compound represented by the above formula (II) are shown below, but the present invention is not restricted to them.

II-1 $ICH_2CONH_2$

II-2 $ICH_2CH_2CONH_2$

II-3 $ICH_2CONHCH_3$

II-4

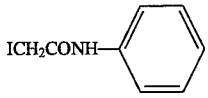

II-5

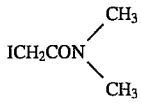

II-6

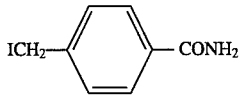

II-7

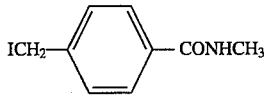

-continued

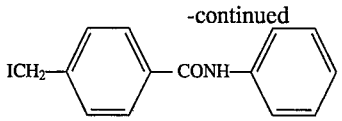

II-8

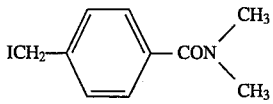

II-9

$ICH_2CH_2SO_2CH_2CONH_2$ II-10

$ICH_2CH_2SO_2CH_2CH_2CONH_2$ II-11

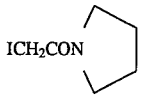

II-12

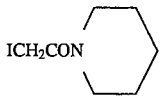

II-13

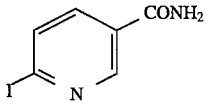

II-14

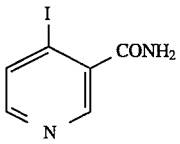

II-15

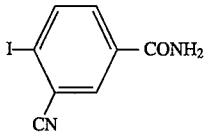

II-16

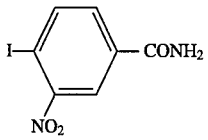

II-17

With respect to the synthetic method for the iodide-ion-releasing compound of formula (I) or (II) for use in the present invention, reference is made to the following literatures:

*J. Am. Chem. Soc.*, 76, 3277–8 (1954); *J. Org. Chem.*, 16, 798 (1951); *Chem. Ber.*, 97, 390 (1964); *Org. Synth.*, V, 478 (1973); *J. Chem. Soc.*, 1951, 1851; *J. Org. Chem.*, 19, 1571 (1954); *J. Chem. Soc.*, 1952, 142; *J. Chem. Soc.*, 1955, 1383; *Angew, Chem.*, Int. Ed., 11, 229 (1972); and *Chem. Commu.*, 1971, 1112.

Typical synthetic examples of compound represented by formula (I) are shown below. Other compounds can be synthesized in a similar manner.

SYNTHETIC EXAMPLE 1

Synthesis of Compound I-3

2-Aminoethane-1-sulfonic acid (33 g) and sodium hydrogencarbonate (44.3 g) were dissolved in water (390 ml) and then p-chloromethylbenzoyl chloride (50 g) was added dropwise slowly thereto at room temperature. After the addition, the reaction was allowed to continue for 5 hours; then the reaction mixture was filtered, and NaCl (40 g) was added to the filtrate. The deposited crystals were filtered and dissolved in water (850 ml), and then sodium iodide (48.8 g) was added to the solution, followed by stirring for 2 hours at room temperature. The deposited crystals were filtered and dried, to obtain the desired material (yield: 60 g). The chemical structure was confirmed by NMR spectrometry, MS spectrometry, IR spectrometry, and elemental analysis.

SYNTHETIC EXAMPLE 2

Synthesis of Compound I-6

After sodium hydrogencarbonate (57.5 g) and sulfanilic acid (52 g) were dissolved in water (450 ml), chloroacetyl chloride (38.6 g) was added dropwise thereto slowly under ice-cooling. After the addition the reaction was allowed to continue for 30 min; then sodium iodide (68.5 g) was added, and they were reacted for 2 hours at 70° C.

After the completion of the reaction, the reaction mixture was hot-filtered and the filtrate was cooled. The deposited crystals were filtered and dried, to obtain the desired material (yield: 79 g). The chemical structure was confirmed by NMR spectrometry, MS spectrometry, IR spectrometry, and elemental analysis.

The iodide-ion-releasing compound of formula (I) or (II) of this invention gives off an iodide ion by the reaction with an iodide-ion-release regulator (a base and/or a nucleophilic reagent), and preferably the nucleophilic reagent used therefore includes the following chemical species:

For example, a hydroxide ion, a sulfite ion, hydroxylamine, a thiosulfate ion, a metabisulfite ion, hydroxamic acids, oximes, dihydroxybenzenes, mercaptans, sulfinic acids, carboxylic acids, ammonia, amines, alcohols, ureas, thioureas, phenols, hydrazines, hydrazides, semicarbazides, phosphines, and sulfides can be mentioned.

In the present invention, by controlling the pH, the concentration of the nucleophilic reagent, the addition technique, and the temperature of the reaction solutions, the releasing speed of the iodide ion of the iodide-ion-releasing compound or the releasing timing thereof can be controlled. As a base for controlling the pH, an alkali hydroxide is preferably mentioned.

Preferably the concentration range of each of the iodide-ion-releasing compound and the iodide-ion-release regulator used for producing rapidly iodide ions is $1\times10^{-7}$ to 20M, more preferably $1\times10^{-5}$ to 10M, further more preferably $1\times10^{-4}$ to 5M, and particularly preferably $1\times10^{-3}$ to 2M. Preferably the temperature range is 30° to 80° C., more preferably 35° to 75° C., and particularly preferably 35° to 60° C.

In the present invention, if a base is used at the time of releasing iodide ions, the pH of the reaction solution for the formation of silver halide grains may be changed.

At that time, for controlling the releasing speed of iodide ions and the releasing timing thereof, a preferable pH range (after adjusting the pH) is 2 to 12, more preferably 3 to 11, particularly preferably 4 to 10, and most preferably 7 to 10. Even under neutral conditions having a pH of 7, the hydroxide ions that are determined by the ion product of water act, as a regulator.

Also, a nucleophilic reagent and a base may be used in combination, in which case, the pH may be controlled in the above range to control the releasing speed of iodide ions and the releasing timing of iodide ions.

A preferable range of the amount of the iodide ions released from an iodide-ion-releasing compound is not particularly restricted and varies according to the purpose of the properties of the formed silver halide grains, with preference given to 0.1 to 20 mol %, more preferably 0.3 to 15 mol %, and particularly preferably 1 to 10 mol %, based on the total silver halide amount.

When iodine atoms are released from an iodide-ion-releasing compound in the form of iodide ions, all iodine atoms may be released or part thereof may remain undecomposed.

The technique for controlling the release of the iodide ion from an iodide-ion-releasing compound will be described below.

If the speed of supply of the iodide ions from an iodide-ion-releasing compound is too slow; that is, if it takes too long a time to form a silver halide phase containing silver iodide, it causes the silver halide phase containing silver iodide to redissolve, resulting in a decrease in dislocation density with respect to the below-mentioned dislocation. On the other hand, to supply iodide ions slowly is preferred since, in that case, grains are formed in such a manner that the distribution of the dislocations does not become nonuniform from grain to grain.

Accordingly, in this case, it is important to produce iodide ions precipitously and not to cause the occurrence of locality (nonuniform distribution) of iodide ions. The reason why regions where the locality of iodide ions is large are formed is that, when an iodide-ion-releasing compound, or an iodide-ion-release regulator that is used in combination with the iodide-ion-releasing compound, is added to the reaction solution in a vessel in which grains will be formed, the speed of the iodide-ion-releasing reaction is too fast in conformity with the nonuniform distribution of the local concentration of the additive caused near the addition port.

Since the period in which the released iodide ion deposits on the host grain is quite short and the growth of grains takes place in the region near the addition port, where the locality of iodide ions is large, the growth of grains that are nonuniform from grain to grain occurs. Therefore, a speed of the release of iodide ions must be chosen so that the localization of the iodide ions may not take place.

In the conventional method in which, for example, an aqueous potassium iodide solution is added, even if the aqueous potassium iodide solution is diluted and added, since the iodide ions are added in the free state, there is a limit to the attempt to reduce the localization of the iodide ions. That is, it is difficult to form grains free of nonuniformity from grain to grain by the conventional method.

However, in comparison with the conventional method, the method of the present invention, which can control the speed of release of iodide ions or the timing of the release thereof, can reduce the locality of iodide ions. In such a case as the above example, the present invention, wherein the grain formation is carried out while iodide ions are precipitously formed without producing the locality, enables to introduce dislocations densely and more uniformly among the grains than the case of the conventional method, but the application of the present invention is not limited to the above and the present invention is characterized in that the speed of release of iodide ions and the timing of release thereof can be controlled in accordance with the purpose, and grains having reduced nonuniformity from grain to grain can be formed.

The control of the release of iodide ions in the present invention is preferably carried out in the following manner. That is, a method is suggested wherein iodide ions are uniformly released from an iodide-ion-releasing compound, which had been added and distributed uniformly into a reaction solution in a grain-forming vessel, by controlling the whole reaction solution to change, for example, the pH, the concentration of the nucleophilic substance, or the temperature, generally, to change the pH to be increased.

In the above, preferably, an iodide ion release regulator, such as a nucleophilic substance or an alkali, for increasing the pH at which iodide ions are released is added with the iodide ion releasing compound distributed uniformly throughout.

Silver halide emulsion grains formed by the present invention (hereinafter referred to as present emulsion grains) will now be described.

The present emulsion grains are made of a silver halide that contains silver iodide. The present emulsion grains contain at least one phase among a silver iodide phase, a silver iodobromide phase, a silver bromochloroiodide phase, and a silver chloroiodide phase. These may further contain another silver salt, such as silver rhodanate, silver sulfide, silver selenide, silver carbonate, silver phosphate, or an organic acid silver salt, in the form of separate grains or as part of the silver halide grains.

Preferably, the present emulsion grains have the following structures in accordance with the halogen composition:

(1) In the case of grains having one or more covering shells over the core, the inner shell or the outermost shell having a multiple structure such as a double structure, a triple structure, a quadruple structure, a quintuple structure, or the like is formed by the iodide-ion-releasing method of the present invention.

(2) In the case of grains having deposited one or more layers (shell regions) covering incompletely the core, the inner layer or the outermost layer having a multiple structure such as a double structure, a triple structure, a quadruple structure, a quintuple structure, or the like is formed by the iodide-ion-releasing method of the present invention.

(3) In the case of junction grains having parts epitaxially grown selectively on a core, the epitaxial parts on the apexes of the grains, the peripheral parts, or the major flat parts of the grains are formed by the iodide-ion-releasing method of the present invention.

Preferably the composition of the covering shell, the deposited layer, and the epitaxial part of the silver halide that contains silver iodide that is formed by using the iodide-ion-releasing method of the present invention is high in silver iodide content. Although their silver halide phase may be made of any of silver iodide, silver iodobromide, silver bromochloroiodide, and silver chloroiodide, preferably it is made of silver iodide or silver iodobromide, and more preferably it is made of silver iodide. If the silver halide phase is made of silver iodobromide, preferably the silver iodide (iodide ion) content is 1 to 45 mol %, more preferably 5 to 45 mol %, and particularly preferably 10 to 45 mol %.

As a mode of the iodide-ion-releasing method of the present invention, preferably silver halide grains containing dislocations are prepared, and particularly preferably dislocations are introduced densely within silver halide grains. For example, in the process for introducing dislocations within tabular grains, while iodide ions are precipitously produced, a silver halide phase containing silver iodide is formed on the edges of the grains (for example, tabular grains), which is preferable with a view toward introducing dislocations densely. The term "dislocations" means linear lattice defects present at the boundary between a slipped region and a not-yet-slipped region on a slip plane of a crystal.

With respect to dislocations of silver halide crystals, reference will be made to such literature as (1) C. R. Berry. *J. Appl. Phys.*, 27, 636 (1956); (2) C. R. Berry. D. C. Skilman, *J. Appl. Phys.*, 35, 2165 (1964); (3) J. F. Hamilton, *Phot. Sci. Eng.*, 11, 57 (1967); (4) T. Shiozawa, *J. Soc. Phot. Sci. Jap.*, 34, 16 (1971); and (5) T. Shiozawa, *J. Soc. Phot. Sci. Jap.*, 35, 213 (1975); and dislocations can be analyzed by the X-ray diffraction method or a direct observation method using a low-temperature transmission electron microscope.

If dislocations are to be observed directly under a transmission electron microscope, silver halide grains, which have been taken out from the emulsion with care so that pressure that would cause dislocations in the grains would not be applied, are placed on a mesh for electron microscope observation and are observed by the transmission method with the sample cooled to prevent damage (e.g., printout) due to an electron ray. In this case, the thicker the grains are, the less the electron ray is transmitted, and therefore if a high-voltage (200 kV or higher for a thickness of 0.25 μm) electron microscope is used, a more clear observation can be made.

On the other hand, with reference to the influence of dislocations on photographic performance, reference will be made to G. C. Farnell, R. B. Flint, and J. B. Chanter, *J. Phot. Sci.*, 13, 25 (1965), which shows that, in high-aspect-ratio tabular silver halide grains of a large size, there is close relationship between the site where a latent-image nucleus will be formed and defects in the grain.

JP-A Nos. 220238/1988 and 201649/1989 disclose tabular silver halide grains in which dislocations are intentionally introduced. These patent applications show that, in comparison with tabular grains free of dislocation lines, tabular grains having dislocation lines introduced are excellent in photographic characteristics, such as sensitivity and reciprocity law.

Based on the present method, preferably dislocations are introduced in silver halide grains as follows:

Silver halide grains that will serve as cores are prepared and silver halide phases containing silver iodide (silver halide covering shells, deposited layers, or epitaxially grown parts as mentioned above) are formed on the silver halide core grains. As described above, the higher the silver iodide content is, the more preferable these silver halide phases are.

Preferably, the average silver iodide content of the core grain is 0 to 15 mol %, more preferably 0 to 12 mol %, and particularly preferably 0 to 10 mol %. The amount of the halogen that will be added to form a high-silver-iodide content phase (meaning a high-silver-iodide-containing region, which is referred to as high-silver-iodide phase hereinafter) on the core grain is preferably 2 to 15 mol %, more preferably 2 to 10 mol %, and particularly preferably 2 to 5 mol %, based on the amount of the silver of the core grain. In this case, preferably the high-silver-iodide phase is present in the range of 5 to 80 mol %, more preferably 10 to 70 mol %, and particularly preferably 20 to 60 mol %, from the center of the grain in terms of the amount of silver of the whole grain.

The site where the high-silver-iodide phase is formed on the core grain can be optionally selected. As described later, in the case of tabular grains, only the vicinities of the apexes of the hexagon or all the fringes can be selected. Although the high-silver-iodide phase may cover the core grain or may be formed on only a specified part thereof, preferably specified parts are selected and the high-silver-iodide phase is epitaxially grown thereon, to control positions of dislocations in the grain. In forming the high-silver-iodide phase, the following may be chosen at will: composition of the halogen to be added, the method of the addition thereof, the temperature of the reaction solution, the pAg, the concentration of the solvent, the concentration of gelatin, the strength of ions, etc.

Thereafter, on the outside of the high-silver-iodide phase, a silver halide shell (region) that is not a high-silver-iodide phase can further be formed, to introduce dislocations.

Although the composition of the silver halide shell may be any of silver bromide, silver iodobromide, and silver bromochloroiodide, preferably it is silver bromide or silver iodobromide. In the case of silver iodobromide, preferably the silver iodide content is 0.1 to 12 mol %, more preferably 0.1 to 10 mol %, and most preferably 0.1 to 3 mol %.

In the process for introducing dislocations, preferably the temperature is 30° to 80° C., more preferably 35° to 75° C., and particularly preferably 35° to 60° C., and preferably the pAg is 6.4 to 10.5.

In the case of tabular silver halide grains, from the photograph of the grains taken by using an electron microscope as described above, the positions and the number of dislocations of each grain viewed perpendicularly to the principal plane can be determined. Since, depending on the angle of the slant of the sample to the electron ray, dislocation lines can or cannot be seen, in order to observe all dislocation lines, it is required that the angle of the slant of the same grain is changed as many times as possible in taking photographs, which photographs are then observed to find the positions and the number of dislocation lines. In the present invention, preferably use is made of a high-voltage electron microscope to take five photographs of the same grain with the angle of the slant changed stepwise by 5° to find the positions and the number of dislocation lines.

In the present invention, to introduce dislocations in tabular silver halide grains, although the positions can be selected such that, for example, dislocations are introduced only at the apexes or the fringes of the grains, or they are introduced throughout the principal planes, preferably the dislocations are introduced particularly limitedly to the fringes. In the present invention, "fringes" means outer peripheries of a tabular grain; more particularly, in the distribution of silver iodide from the edge toward the center of a tabular grain, the outside of a point viewed from the edge where the silver iodide content becomes over or below the average silver iodide content of the whole grain is referred to as a "fringe."

To introduce dislocations in tabular grains, preferably the fringes of the tabular grain are caused to have about up to 1,000 but no less than 10 dislocation lines, preferably no less than 30 dislocation lines, and particularly preferably no less than 50 dislocation lines, when they are counted by the method using an electron microscope described above. If dislocation lines are observed to be present closely or in a crossed manner, in some cases the number of dislocation lines per grain cannot be counted clearly. However even in that case, they can roughly be counted in terms of about tens, about twenties, or about thirties.

Desirably the distribution of the quantity of dislocations of silver halide grains is uniform from grain to grain. In the present invention, when dislocations are introduced in tabular grains, preferably tabular grains having 10 or more dislocation lines at the fringes per grain amount to 100 to 50% (in terms of the number), more preferably 100 to 70%, and particularly preferably 100 to 90%, of all the grains.

In the present invention, to find the rate of grains containing dislocations and the number of dislocation lines, preferably dislocation lines of at least 100 grains, more preferably 200 grains or more, particularly preferably 300 grains or more, are directly observed.

The term "tabular silver halide grains" refers to silver halide grains having two opposite parallel principal planes. The silver halide grain has one twin plane or two or more parallel twin planes. The term "twin plane" refers to a (111) plane wherein ions at all the lattice points on opposite sides of the plane (111) have a mirror-image relationship. The tabular grain is triangular, hexagonal, or triangularly or hexagonally circular in shape viewed from above the grain, and it has parallel outer surfaces. Assuming the tabular grain to be circular in shape, the diameter of the tabular grain is preferably 0.3 to 10 μm, more preferably 0.4 to 5 μm, and particularly preferably 0.5 to 4 μm. Preferably the thickness of the tabular grain is 0.05 to 1.0 μm, more preferably 0.08 to 0.5 μm, and particularly preferably 0.08 to 0.3 μm. Preferably the aspect ratio of the tabular grain is from 2 to 30, and more preferably from 3 to 25.

The term "aspect ratio" means the value obtained by dividing the diameter of the projected area of the silver halide grain by the thickness of the grain assuming the projected area to be circular in shape. An example of the method for measuring the aspect ratio is a technique wherein a transmission electronmicrograph is taken by the replica method, to find the diameter of the projected area of the grain and the thickness of the grain, assuming the grain to be circular in shape. In this case, the thickness is calculated from the length of the shadow of the replica.

By using the iodide-ion-releasing method of the present invention, the outermost shell near the surface of the silver halide grain is prepared, which is a preferable mode.

The formation of a silver halide phase that contains silver iodide near the grain surface is important in view of the intensification of the adsorptivity of dyes and the control of the developing speed. In the present invention, these factors can be controlled by choosing a silver iodide content of the silver halide phase of the outermost shell near the grain surface in accordance with the purpose.

Desirably the halogen composition of the surfaces of the silver halide grains is uniform from grain to grain and, according to the present invention, uniformity among the grains that has not been achieved by the conventional technique can be attained. Herein "grain surface" means the region extending about 50 Å from the surface. The halogen composition of such a region can be measured by the surface analysis method, such as XPS (X-ray photoelectron spectroscopy) or ISS (ion-scattering spectrometry).

In this embodiment, preferable silver halide grains are those wherein the silver iodide content of the silver halide phase of the grain surface of the emulsion grain, measured by these surface analysis methods, is 0.1 to 15 mol %, more preferably 0.3 to 12 mol %, particularly preferably 1 to 10 mol %, and most preferably 3 to 8 mol %.

According to the present invention, the halogen composition can be made uniform from grain to grain throughout all the grains, which has not been achieved by the conventional technique.

The deviation coefficient of the silver iodide content distribution of individual emulsion grains from grain to grain obtained in accordance with the present invention is preferably 20 to 3%, more preferably 15 to 3%, and particularly preferably 10 to 3%. The silver iodide content of individual emulsion grains can be measured by analyzing the composition of the grains one by one using an X-ray micro-analyzer. The term "deviation coefficient of the silver iodide content distribution" refers to the value obtained by dividing the scatter (standard deviation) of the silver iodide contents of individual grains by the average silver iodide content.

Emulsions of the present invention and other emulsions falling outside the present invention that will be used in combination with the former emulsions are described below.

The silver halide grains for use in the present invention are made of silver bromide, silver chloride, silver iodide, silver chlorobromide, silver chloroiodide, silver iodobromide, or silver bromochloroiodide. A silver salt other than these, such as silver rhodanate, silver sulfide, silver selenide, silver carbonate, silver phosphate, as well as an organic acid silver salt, in the form of separate grains or as part of the silver halide grains, may be contained.

In the grains of the silver halide emulsion of the present invention, preferably the halogen composition has a distribution or a structure. Typical examples are grains of a double-structure type or core-shell type, in which types the inner part and the surface layer have different halogen compositions as disclosed, for example, in JP-B ("JP-B" means examined Japanese patent publication) No. 13162/1968 and JP-A Nos. 215540/1986, 222845/1985, 143331/1985, and 75337/1986. In addition to the double structure, a triple structure, as disclosed in JP-A No. 222844/1985, or an even higher multilayer structure is possible, and such grains having a core-shell double structure whose surface has a thin layer having a different silver halide composition are also possible.

To allow the inner part of the grains to have a structure, the grains can have not only the above inclusion structure but also a so-called junction structure. Examples thereof are disclosed, for example, in JP-A Nos. 133540/1984 and 108526/1983, European Patent No. 199,290A2, JP-B No. 24772/1983, and JP-A No. 16254/1984. The crystal to be joined has a composition different from that of the host crystal and is joined to the edges, the corners, or the planes of the host crystal. Such a junction crystal may be formed if the host crystal is uniform in halogen composition or has a core-shell-type structure.

In the case of a junction structure, in addition to a junction structure of a combination of a silver halide with a silver halide, a junction structure of a combination of a silver halide with a silver salt compound having no rock salt structure, such as silver rhodanate and silver carbonate, can be utilized. If a junction structure is possible, a non-silver-salt compound, such as lead oxide, can be used.

In the case of grains of silver iodobromide or the like that have these structures, a preferable mode is that the core has a silver iodobromide content higher than that of the shell. In some cases, preferably the shell has a silver iodobromide content higher than that of the core. Similarly, in the case of grains having a junction structure, the host crystal may be higher in silver iodide content while the joined crystal may be relatively lower in silver iodide content, or these may be reversed. The boundary part of the grains having these structures in which the halogen compositions are different may be a definite boundary or an indistinct boundary. A mode wherein the composition is changed positively continuously is also preferable.

In the case of silver halide grains in which two or more silver halides are present as a mixed crystal or the grains have a structure, it is important that the halogen composition distribution among the grains is controlled. A method for measuring the halogen composition distribution among grains is described in JP-A No. 254032/1985. Desirably the halogen distribution is uniform among the grains. In particular, an emulsion that has a deviation coefficient of 20 to 30%, i.e., its uniformity is high, is preferable. Another preferable mode is an emulsion wherein the grain size and the halogen composition are correlated. An example is a case whose correlation is that the larger the grain size is, the higher the iodide content is, and the smaller the grain size is, the smaller the iodide content is. In accordance with the purpose, the reversed correlation or a correlation using another halogen composition can be chosen. For this purpose, preferably, two or more emulsions different in composition are mixed.

It is important to control the halogen composition near the surface of the grains. Since increasing the silver iodide content or the silver chloride content near the surface of the grains changes the adsorptivity of dyes or the developing speed, the said content is chosen in accordance with the purpose. If the halogen composition near the surface is changed, either a structure in which the different composition covers the whole grain, or a structure in which the different composition covers part of the grain, can be chosen. For example, there are a case wherein only one plane of a tetradecahedral grain consisting of (100) and (111) planes is different in halogen composition, and a case in which one of principal planes and side planes of a tabular grain is different in halogen composition.

The silver halide grains used in the present invention may be, for example, normal crystals having no twining plane or crystals explained in *Shashin Kogyo no Kiso,* Ginen Shashin-hen, edited by Nihon Shashin-gakkai (Korona-sha), page 163, such as single-twin crystals having one twining plane, multi-twin crystals having two or more parallel twining planes, and nonparallel multi-twin crystals having two or more nonparallel twining planes, which may be chosen in accordance with the purpose. Examples wherein grains different in shape are mixed are disclosed in U.S. Pat. No. 4,865,964, and if required this technique can be chosen. In the case of normal crystals, cubic grains whose planes consist of (100) planes, octahedral grains whose planes consist of (111) planes, and dodecahedral grains whose planes consist of (110) planes disclosed in JP-B No. 42737/1980 and JP-A No. 222842/1985, can be used. As reported in *Journal of Imaging Science,* Vol. 30, page 247, 1986, (h11) plane grains whose planes consist typically of (211) planes, (hh1) plane grains whose planes consist typically of (331) planes, (hk0) plane grains whose planes consist typically of (210) planes, and (hk1) plane grains whose planes consist typically of (321) planes, can also be chosen to be used in accordance with the purpose, although the preparation must be devised. Grains having two or more types of planes, such as tetradecahedral grains whose planes have (100) and (111) planes in a single grain, grains having both (100) and (110) planes, and grains having both (111) and (110) planes, can also be chosen to be used in accordance with the purpose.

Tabular grains having an aspect ratio of greater than 1 can be used in the present invention. Tabular grains can be prepared by methods described, for example, by Cleve in *Photographic Theory and Practice* (1930), page 131; by Gutoff in *Photographic Science and Engineering,* Vol. 14, pages 248 to 257 (1970); and in U.S. Pat. Nos. 4,434,226, 4,414,310, 4,433,048, and 4,439,520, and British Patent No. 2,112,157. If tabular grains are used, such advantages are obtained that the covering power is increased and the color sensitization efficiency by sensitizing dyes is raised, which is described in detail in the above-mentioned U.S. Pat. No. 4,434,226. Desirably the average aspect ratio of 80% or more of all the projected areas of grains is 1 or over but less than 100, more preferably 2 or over but less than 30, and particularly preferably 3 or over but less than 25. The shape of the tabular grains may be chosen to be, for example, triangular, hexagonal, and circular. A regular hexagon whose six sides have approximately equal lengths, as described in U.S. Pat. No. 4,797,354, is a preferable form.

The diameter of the tabular grains with the shape thereof being assumed to be circular is preferably 0.15 to 5.0 μm. Preferably the thickness of such tabular grains is 0.05 to 1.0 μm.

Preferably the ratio of the tabular grains is such that those having an aspect ratio of 2 or over amount to 50% or more, more preferably 80% or more, and particularly preferably 90% or more, of all the projected areas.

In some cases, monodisperse tabular grains are used to obtain more preferable results. The structure of monodisperse tabular grains and the method for producing them follow the description, for example, of JP-A No. 151618/1988. The shape thereof can be described briefly as follows: 70% or more of all the projected areas of silver halide grains has hexagonal shapes wherein the ratio of the length of the longest side to the length of the shortest side is 2 or less, and are taken up by tabular silver halide having two parallel outer surfaces. Further, with respect to the said hexagonal silver halide grains, the deviation coefficient (the value obtained by dividing the scatter (standard deviation) of the grain sizes in terms of the diameter of the projected area with the shape of the grain assumed to be as a circle by the average grain size) of the grain size distribution of the hexagonal tabular silver halide grains is 20 to 30%.

Use of grains having dislocations is preferable.

In the case of tabular grains, dislocation lines can be observed under a transmission electron microscope. Preferably grains having no dislocation lines, grains having several dislocation lines, or grains having many dislocation lines, are chosen in accordance with the purpose. Selection may be made, for example, from grains wherein dislocation lines are introduced in special directions of the crystal orientations in a straight manner or curved manner, and from grains wherein dislocation lines are introduced throughout the grains or are introduced only into specified parts of the grains, for example limitedly into the fringes of the grains. In addition to the introduction of dislocation lines into tabular grains, also the introduction of dislocation lines into regular crystal grains and irregular grains, typically potato grains, is also preferable. In this case, the mode wherein the introduction of dislocation lines is limited to special parts of grains, such as apexes or edges, is a preferable mode.

The silver halide emulsion that is used in the present invention may be subjected to a treatment for making grains round, as disclosed, for example, in European Patent No. 96,727 B1 or 64,412 B1, or it may be subjected to a treatment for surface modification, as disclosed in West German Patent No. 2,306,447 C 2 or JP-A No. 22130/1985.

Although the surface of grains generally has a flat structure, in some cases preferably that the surface of grains is intentionally made rough. An examples is a method described in JP-A No. 106532/1983 or 221320/1985, wherein holes are made in part of crystals, for example in the apexes or centers of planes of crystals, and another example is ruffle grains described in U.S. Pat. No. 4,643,966.

The grain size of the emulsion for use in the present invention can be evaluated, for example, by the diameter of the projected area by using an electron microscope with the grain assumed to be circular in shape, or the diameter of the grain volume with the grain assumed to be a sphere that is calculated from the projected area and the thickness of the grain, or the diameter of the grain with the grain assumed to be a sphere that is obtained by the Coulter counter method. Grains can be chosen from grains ranging from ultrafine grains having a diameter of 0.05 μm or less to coarse grains having a diameter of more than 10 μm with the grain assumed to be a sphere. Preferably, grains of 0.1 μm or more but 3 μm or less can be used as photosensitive silver halide grains.

As the emulsion of regular crystals used in the present invention, a so-called polydisperse emulsion having a wide grain size distribution, or a monodisperse emulsion having a narrow size distribution, can be chosen to be used in accordance with the purpose. As a scale for expressing the size distribution, in some cases the deviation coefficient of the diameter of the projected area of the grain assuming the grain to be circular in shape or the deviation coefficient of the diameter of the grain assuming the grain to be a sphere is used. If a monodisperse emulsion is used, an emulsion having a size distribution whose deviation coefficient is 25 to 3%, more preferably 20 to 3%, and further more preferably 15 to 3%, is suitably used.

In some cases, the monodisperse emulsion is to be one having a grain size distribution wherein 80% or more of all the grains are within ±30% of the average grain size in terms of the number or weight of the grains. In order to make the photographic material satisfy the intended gradation, it is possible that two or more monodisperse silver halide emulsions different in grain size may be mixed to be included in one layer of emulsion layers having substantially the same color sensitivity, or they may be added separately to emulsion layers having substantially the same color sensitivity. Further, it is possible that two or more polydisperse silver halide emulsions or a monodisperse emulsion and a polydisperse emulsion can be used in combination to be mixed or to be applied as separate layers.

The emulsions of the present invention and photographic emulsions used therewith can be prepared by using the methods described, for example, by P. Glafkides in *Chimie et Physique Photographique,* Paul Montel, 1967, by G. F. Duffin in *Photographic Emulsion Chemistry* (Focal Press, 1966), and by V. L. Zelikman et al., in *Making and Coating Photographic Emulsion,* Focal Press, 1964. That is, any of the acid method, the neutral method, the ammonia method, etc. can be used and to allow the soluble silver salt to react with the soluble halide, any of the single-jet method, the double-jet method, and the combination thereof, and the like can be used. The method wherein grains are formed in the presence of excess silver ions (the so-called reverse mixing method) can also be used. As one type of the double-jet method, a method wherein the pAg in the liquid phase where a silver halide will be produced is kept constant, i.e., the controlled double-jet method can also be used. According to this method, a silver halide emulsion wherein the shape of the crystals is regular and the grain size is approximately uniform can be obtained.

In some cases, a method wherein silver halide grains previously formed by precipitation are added to a reaction vessel for the preparation of an emulsion, and the methods described in U.S. Pat. Nos. 4,334,012, 4,301,241, and 4,150,994, are preferable. These grains can be used as seed crystals, and they are also effective when they are supplied as a silver halide for the growth. In the latter case, it is preferable to add an emulsion whose grain size is small, and all of it can be added at one time, or it can be added in portions or continuously. In some cases, it is effective to add grains having different halogen compositions in order to modify the surface.

The method wherein most or only a small part of the halogen composition of silver halide grains is converted by the halogen conversion method is disclosed, for example, in U.S. Pat. Nos. 3,477,852 and 4,142,900, European Patent Nos. 273,429 and 273,430, and West German Offenlegungschrift No. 3,819,241, and it is an effective grain-forming method. For the conversion to a more sparingly soluble silver salt, a solution of a soluble halogen or silver halide grains can be added. The conversion can be effected at one time, stepwise, or continuously.

As a method for growing grains, in addition to a method wherein a soluble silver salt and a halide are added with them having constant concentrations at constant flow velocities, a method for forming grains wherein the concentrations or flow velocities are changed, as described in British Patent No. 1,469,480 and U.S. Pat. Nos. 3,650,757 and 4,242,445, is a preferable method. By increasing the concentrations or flow velocities, the amount of a silver halide to be supplied can be changed in accordance with a linear function, a quadratic function, or a more complex function of the addition time. In some cases, if required, decreasing the amount of the silver halide to be supplied is preferable. Further, when several soluble silver salts different in solution composition or several soluble halides different in solution composition are added, an addition method wherein one of them is increased and the other is decreased is an effective method.

As a mixing vessel in which a solution of a soluble silver salt and a solution of a soluble halide are caused to react, a method can be used by choosing from methods described in U.S. Pat. Nos. 2,996,287, 3,342,605, 3,415,650, and 3,785,777, and West German Offenlegungschrift Nos. 2,556,885 and 2,555,364.

To facilitate the ripening, silver halide solvents are effective. For example, to facilitate the ripening, it is known to allow an excess amount of halide ions to be present in a reaction vessel. Other ripening agents can also be used. These ripening agents can be used in such a manner that all the amount thereof is mixed in a dispersion medium in a reaction vessel before silver and a halide are added, or in such a manner that the ripening agent is introduced into a reaction vessel together with a halide, a silver salt, or a defloculating agent. As another modification, a ripening agent is introduced independently at a step of adding a halide and a silver salt.

For example, ammonia, a thiocyanate (e.g., potassium rhodanate and ammonium rhodanate), an organic thioether compound (e.g., compounds described, for example, in U.S. Pat. Nos. 3,574,628, 3,021,215, 3,057,724, 3,038,805, 4,276,374, 4,297,439, 3,704,130, and 4,782,013 and JP-A No. 104926/1982), a thion compound (e.g., tetrasubstituted thioureas described, for example, in JP-A Nos. 82408/1978 and 77737/1980 and U.S. Pat. No. 4,221,863 and compounds described in JP-A No. 144319/1978), a mercapto compound capable of facilitating the growth of silver halide grains described in JP-A No. 202531/1982, and an amine compound (e.g., those described in JP-A No. 100717/1979) can be mentioned.

As a protective colloid used at the time of preparation of the present emulsion and as a binder for other hydrophilic colloid layers, gelatin is advantageously used, but other hydrophilic colloids can also be used.

For example, proteins, such as a gelatin derivative, a graft polymer of gelatin with other polymer, albumin, and casein; cellulose derivatives, such as hydroxyethyl cellulose, carboxymethylcellulose, and cellulose sulfate, saccharide derivatives, such as sodium alginate and starch derivatives;

and various synthetic hydrophilic polymers including homopolymers and copolymers, such as a polyvinyl alcohol, a polyvinyl alcohol partial acetal, a poly-N-vinyl pyrrolidone, a polyacrylic acid, a polymethacrylic acid, a polyacrylamide, a polyimidazole, and a polyvinyl pyrazole, can be mentioned.

As gelatin, in addition to lime-processed gelatin, an acid-processed gelatin and an enzyme-processed gelatin as described in *Bull. Soc. Sci. Photo. Japan.* No. 16, p. 30 (1966) can be used and a hydrolysate or an enzymolyte of gelatin can be used as well.

Preferably, the emulsion of the present invention is washed with water to desalt and is dispersed in a freshly prepared protective colloid. Although the temperature at which the washing with water is carried out can be chosen in accordance with the purpose, preferably it is chosen in the range of 5° to 50° C. Although the pH at which the washing with water is carried out can be chosen in accordance with the purpose, preferably it is chosen in the range of 2 to 10, preferably 3 to 8. Although the pAg at which the washing with water is carried out can be chosen in accordance with the purpose, preferably it is chosen in the range of 5 to 10. The method of washing can be chosen among the noodle washing method, the dialysis method using a translucent film, the centrifugal method, the coagulation settling method, and the ion exchange method. In the case of the coagulation settling method, it is possible to choose one among the method using a sulfate, the method using an organic solvent, the method using a water-soluble polymer, and the method using a gelatin derivative.

When the emulsion of the present invention is prepared, it is preferable to allow a salt of a metal ion to be present, for example, at the time of the formation of the grains, in the step of desalting, at the time of chemical sensitization, or before the coating, in accordance with the purpose. When the grains are doped, it is preferable to add the dopant at the time of the formation of the grains, or if the dopant is used for the modification of the grain surface or as a chemical sensitizing agent, preferably it is added after the formation of the grains bun before the completion of the chemical sensitization. Selection can be made among the case wherein the whole grain is doped, the case wherein only the core part, the shell part, or the epitaxial part of the grain is doped, and the case wherein only the core grain is doped. Use can be made, for example, of Mg, Ca, Sr, Ba, Al, Sc, Y, La, Cr, Mn, Fe, Co, Ni, Cu, Zn, Ga, Ru, Rh, Pd, Re, Os, It, Pt, Au, Cd, Hg, Tl, In, Sn, Pb, and Bi. These metals can be added if they are in the form of a salt that can be dissolved at the time of the formation of the grains, such as an ammonium salt, an acetate, a nitrate, a sulfate, a phosphate, a hydroxide, a six-coordinate complex, and a four-coordinate complex. For example, $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$ can be mentioned. As the ligand of the coordination compound, one can be chosen from among halo, aquo, cyano, cyanate, thiocyanate, nitrosyl, thionitrosyl, oxo, and carbonyl. These compounds may be used alone or as a mixture of two or more.

Preferably the metal compound is added by dissolving it in a suitable solvent, such as water, methanol, or acetone. To stabilize the solution, a technique wherein an aqueous hydrogen halide (e.g., HCl and HBr) solution or an alkali halide (e.g., KCl, NaCl, KBr, and NaBr) is added can be used. If necessary, an acid or an alkali may be added. The metal compound can be added in the reaction vessel before the formation of the grains or can be added during the formation of the grains. It also can be added to a water-soluble silver salt (e.g., $AgNO_3$) or an aqueous alkali halide solution (e.g., NaCl, KBr, and KI) and can be added continuously during the formation of the silver halide grains. Further, the water-soluble silver salt and the alkali halide may be formed into separate independent solutions and they may be added continuously at a suitable time during the formation of the grains. It is also preferable to use several addition methods in combination.

In some cases, a method as described in U.S. Pat. No. 3,772,031, wherein a chalcogen compound is added during the preparation of the emulsion, is useful. Besides S, Se, and Te, a cyanate, a thiocyanate, a selenocyanate, a carbonate, a phosphate, and an acetate may also be present.

The silver halide grains of the present invention can be subjected to at least one of sulfur sensitization, selenium sensitization, gold sensitization, palladium sensitization, or noble metal sensitization, as well as reduction sensitization, in any step of producing the silver halide emulsion. It is preferable to use two or more sensitization methods in combination. Depending the chosen step in which the chemical sensitization will be carried out, various types of emulsions can be prepared. There are a type wherein a chemical sensitizing nucleus is embedded in the grain, a type wherein a chemical sensitizing nucleus is embedded in the shallow position of the grain, and a type wherein a chemical sensitizing nucleus is formed on the surface. The position of the chemical sensitizing nucleus can be chosen for the emulsion of the present invention in accordance with the purpose, and a generally preferable case is one in which at least one chemical sensitizing nucleus is formed near the surface.

One of chemical sensitizations that can preferably be carried out in the present invention is chalcogenide sensitization and noble metal sensitization that can be used alone or in combination, which can be carried out by using an active gelatin as described by T. H. James in *The Theory of the Photographic Process,* 4th ed., Macmillan, 1977, pages 67 to 76; and also as described in Research Disclosure, Vol. 120, April 1974, 12008, Research Disclosure, Vol. 34, June 1975, 13452, U.S. Pat. Nos. 2,642,361, 3,297,446, 3,772,031, 3,857,711, 3,901,714, 4,266,018, and 3,904,415, and British Patent No. 1,315,755, sulfur, selenium, tellurium, gold, platinum, palladium, iridium, or a combination of these can be used at a pAg of 5 to 10, a pH of 5 to 8, and a temperature of 30° to 80° C. In the noble metal sensitization, noble metal salts, for example, of gold, platinum, palladium, and iridium can be used, and particularly gold sensitization and palladium sensitization and a combination of these are preferable. In the case of gold sensitization, a known compound, such as chloroauric acid, potassium chloroaurate, potassium aurithiocyanate, gold sulfide, and gold selenide, can be used. By "a palladium compound" is meant a salt of bivalent or tetravalent palladium. A preferable palladium compound is represented by $R_2PdX_6$ or $R_2PdX_4$, wherein R represents a hydrogen atom, an alkali metal atom, or an ammonium group and X represents a halogen atom, such as a chlorine atom, a bromine atom, or an iodine atom.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$ is preferable.

The gold compound and the palladium compound is preferably used in combination with a thiocyanate or a selenocyanate.

As the sulfur sensitizing agent, hypo, thiourea compounds, rhodanine compounds, and sulfur-containing compounds described in U.S. Pat. Nos. 3,857,711, 4,266,018, and 4,054,457 can be used. The chemical sensitization can be carried out in the presence of a so-called chemical sensitization auxiliary. As a useful chemical sensitization auxiliary, a compound that is known to inhibit fogging during chemical sensitization and to increase sensitivity, such as azaindene, azapyridazine, and azapyridine is used. Examples of the chemical sensitization auxiliary and modifiers are described in U.S. Pat. Nos. 2,131,038, 3,411,914, and 3,554,757, JP-A No. 126526/1983, and by G. F. Duffin in the above-mentioned *Photographic Emulsion Chemistry*, pages 138 to 143.

For the emulsion of the present invention, preferably gold sensitization is additionally used. A preferable amount of a gold sensitizing agent is $1\times10^{-4}$ to $1\times10^{-7}$ mol, more preferably $1\times10^{-5}$ to $5\times10^{-7}$, per mol of the silver halide. A preferable range of the palladium compound is from $1\times10^{-3}$ to $5\times10^{-7}$ mol per mol of the silver halide. A preferable range of the selenocyan compound or the thiocyan compound is from $5\times10^{-2}$ to $1\times10^{-6}$ mol.

A preferable amount of the sulfur sensitizing agent used for the silver halide grains of the present invention is $1\times10^{-4}$ to $1\times10^{-7}$, more preferably $1\times10^{-5}$ to $5\times10^{-7}$ per mol of the silver halide.

As a preferable sensitizing method for the emulsion of the present invention, selenium sensitization is used. In the selenium sensitization, a known unstable selenium compound is used, and specifically colloidal metal selenium and a selenium compound, such as selenoureas (e.g., N,N-dimethylselenourea and N,N-diethylselenourea), selenoketones, and selenoamides, can be used. In some cases, it is preferable to carry out selenium sensitization in combination with sulfur sensitization and/or noble metal sensitization.

Preferably the silver halide emulsion of the present invention is subjected to reduction sensitization during the formation of the grains, or after the formation of the grain but before the chemical sensitization, or during or after the chemical sensitization.

As the reduction sensitization, any one of a method wherein a reduction sensitizing agent is added to a silver halide emulsion; a method called silver ripening, wherein growing or ripening is carried out in an atmosphere having a pAg as low as 1 to 7; and a method called high-pH ripening, wherein ripening is carried out in an atmosphere having a pH as high as 8 to 11, can be chosen. Two or more of these methods can be used in combination.

The method wherein a reduction sensitizing agent is added is a preferable method because the level of the reduction sensitization can be adjusted subtly.

As the reduction sensitizing agent, stannous salts, ascorbic acid and its derivatives, amines and polyamines, hydrazine derivatives, formamidine sulfinate, silane compounds, and borane compounds are known. For the reduction sensitization of the present invention, these known reduction sensitizing agents can be chosen to be used, and two or more these compounds can be used in combination. As the reduction sensitizing agent, stannous salts, thiourea dioxide, dimethylamineborane, and ascorbic acid and its derivatives are preferable compounds. Since the amount of the reduction sensitizing agent to be added is dependent on the production conditions of the emulsion, although it is required to chose an appropriate amount, suitably the amount is in the range of $10^{-7}$ to $10^{-3}$ mol per mol of the silver halide.

The reduction sensitizing agent is dissolved in a solvent, such as water, alcohols, glycols, ketones, esters, and amides, and is added during the formation of the grains. Although the reduction sensitizing agent may previously be added into a reaction vessel, preferably the reduction sensitizing agent is added at a suitable time during the growth of the grains. It is also possible that the reduction sensitizing agent may be previously added to an aqueous solution of a water-soluble silver salt or a water-soluble alkali halide solution, and these aqueous solutions are used to precipitate silver halide grains. Also, preferably that a solution of the reduction sensitizing agent is added in portions or continuously during the growth of the grains over a long period of time.

It is preferable that an oxidizing agent for silver is used during the step of producing the emulsion of the present invention. By "an oxidizing agent for silver" is meant a compound that will act on metal silver to convert it to silver ions. Particularly the compound that converts quite fine silver particles produced concomitantly during the formation of the silver halide grains and during the chemical sensitization of the silver halide grains to silver ions. The silver ions thus produced may form silver salts sparingly soluble in water, such as a silver halide, silver sulfide, and silver selenide, or silver salts readily soluble in water, such as silver nitrate. The oxidizing agent for silver may be inorganic matter or organic matter. Inorganic oxidizing agents include, for example, ozone, hydrogen peroxide and its adducts (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), oxygen acid salts, such as peroxy acid salts (e.g., $K_2S_2O_8$, $K_2C_2O_6$, and $K_2P_2O_8$), peroxy complex compounds (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganates (e.g., $KMnO_4$), and chromates (e.g., $K_2Cr_2O_7$), halogen elements, such as iodine and bromine, perhaloid acid salts (e.g., potassium periodate), salts of polyvalent metals (e.g., potassium hexacyanoferrate), and thiosulfonates.

Examples of the organic oxidizing agent are quinones, such as p-quinone, organic peroxides, such as peracetic acid and perbenzoic acid, and compounds that can give off active halogen (e.g., N-bromosuccinimide, chloramine T, and chloramine B).

Preferable oxidizing agents used in the present invention are such inorganic oxidizing agents as ozone, hydrogen peroxide and its adducts, halogen elements, and thiosulfonates and such organic oxidizing agents as quinones. It is a preferable mode to use the above reduction sensitization in combination with an oxidizing agent for silver. Selection can be made to use one from a method wherein after an oxidizing agent is used, reduction sensitization is carried out, a method wherein after reduction sensitization is carried out, an oxidizing agent is used, and a method wherein the reduction sensitization is carried out with an oxidizing agent being used simultaneously. These methods can be used selectively in the step of forming the grains or in the step of the chemical sensitization.

In the photographic emulsion used in the present invention, various compounds can be contained in order to prevent fogging during the process for producing the photographic material, during the storage of the photographic material, or during the photographic processing, or in order to stabilize the photographic performance. That is, many compounds known as antifogging agents or stabilizers can be used such as thiazoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), mercaptopyrimidines, mercaptotriazines, thioketo compounds, for example, oxadolinethion, and azaindenes, for example, triazaindenes, tetraazaindenes (particularly 4-hydroxy-substituted (1,3,3a,7)tetraazaindenes), and pentaazaindenes. For example, those described in U.S. Pat. Nos. 3,954,474 and 3,982,947 and JP-B No. 28660/1987 can be used. Preferable ones are those described in JP-A No. 212932/1988. The antifogging agent and the stabilizer can be added, for example, before, during, or after the formation of the grains, at the washing step, at the time of dispersion after the washing, before, during, or after the chemical sensitization, or before the application in accordance with the purpose. An antifogging agent and a stabilizer that are added during the preparation of the emulsion can be used for the purpose of, in addition to allowing them to exhibit the inherent antifogging and stabilizing actions, for example, controlling the habit of the grains, making the grains small, decreasing the solubility of the grains, controlling the chemical sensitization, and controlling the arrangement of dyes.

The photographic emulsion used in the present invention is spectrally sensitized with methine dyes or the like in view of preferable exhibition of the effect of the present invention. The dyes that will be used include cyanine dyes, merocyanine dyes, composite cyanine dyes, composite merocyanine dyes, halopolar cyanine dyes, hemicyanine dyes, styrylcyanine dyes, and hemioxonol dyes. Particularly useful dyes are those belonging to cyanine dyes, merocyanine dyes, and composite merocyanine dyes. In these dyes, any nucleus that is generally used in cyanine dyes as a basic heterocyclic nucleus can be used; and examples are a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; nucleuses formed by fusing an cycloaliphatic hydrogen ring to these nucleuses; and nucleuses formed by fusing an aromatic hydrocarbon ring to these nucleuses, i.e., an indolenine nucleus, a benzoindolenine nucleus, an indole nucleus, a benzoxazole nucleus, a naphthooxazole nucleus, a benzothiazole nucleus, a naphthothiazole nucleus, a benzoselenazole nucleus, a benzoimidazole nucleus, and a quinoline nucleus, which may have a substituent on the carbon atom.

In the merocyanine dye or the composite merocyanine dye, as a nucleus having a ketomethylene structure, a 5- to 6-membered heterocyclic nucleus, such as a pyrazolin-5-one nucleus, a thiohydantoin nucleus, a 2-thiooxazolidin-2,4-dione nucleus, a thiazolidin-2,4-dione nucleus, a rhodanine nucleus, and a thiobarbituric acid nucleus, can be applied.

These sensitizing dyes may be used alone or in combination and a combination of the sensitizing dyes is used particularly for the purpose of supersensitization. Typical examples of that are described, for example, in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, JP-B Nos. 4936/1968 and 12375/1978, and JP-A Nos. 110618/1977 and 109925/1977.

In addition to the sensitizing dye, a dye that does not show itself a spectral sensitizing action or a substance that does not substantially absorb visible light but shows supersensitization can be contained in the emulsion.

The time at which the sensitizing dye is added into the emulsion may be at any step known to be useful in the preparation of emulsions. Most generally, the sensitizing dye is added after the completion of the chemical sensitization but before the application, but the sensitizing dye can be added simultaneously with a chemical sensitizing dye as described in U.S. Pat. Nos. 3,628,969 and 4,225,666 to carry out the spectral sensitization and the chemical sensitization at the same time, or can be added prior to the chemical sensitization as described in JP-A No. 113928/1983, or can be added before the completion of the formation of the precipitation of the silver halide grains thereby starting the spectral sensitization. Further, these compounds can be added in portions as taught in U.S. Pat. No. 4,225,666, that is, part of the compounds is added prior to the chemical sensitization, and the rest is added after the chemical sensitization, and the sensitizing dye may be added at any time during the formation of the silver halide grains as disclosed, for example, in U.S. Pat. No. 4,183,756.

The amount to be added may be $4\times10^{-6}$ to $8\times10^{-3}$ per mol of the silver halide, and more preferably in the case wherein the size of the silver halide grains is 0.2 to 1.2 μm, an amount of about $5\times10^{-5}$ to $2\times10^{-3}$ is effectively added.

It is suitable that the photographic material to be used in the present invention is provided with at least one blue-sensitive silver halide emulsion layer, at least one green-sensitive silver halide emulsion layer, and at least one red-sensitive silver halide emulsion layer on a support and there is no particular restrictions on the number and order of the silver halide emulsion layers and the nonphotosensitive layers. A typical example is a silver halide photographic material having on a support at least one photosensitive layer that comprises a plurality of silver halide emulsion layers whose color sensitivities are substantially identical but whose sensitivities are different, the photosensitive layer being a unit photosensitive layer having color sensitivity to any of blue light, green light, and red light, and in a multilayer silver halide color photographic material, the arrangement of the unit photosensitive layers is generally such that a red-sensitive layer, a green-sensitive layer, and a blue-sensitive layer in the order stated from the support side are placed. However, the above order may be reversed according to the purpose and such an order is possible that layers having the same color sensitivity have a layer different in color sensitivity therefrom between them.

Nonphotosensitive layers such as various intermediate layers may be placed between, on top of, or under the above-mentioned silver halide photographic layers.

The intermediate layer may contain, for example, couplers and DIR compounds as described in JP-A Nos. 43748/1986, 113438/1984, 113440/1984, 20037/1986, and 20038/1986 and may also contain a color mixing inhibitor as generally used.

Each of the silver halide emulsion layers constituting unit photosensitive layers respectively can preferably take a two-layer constitution comprising a high-sensitive emulsion layer and a low-sensitive emulsion layer as described in West Germany Patent No. 1,121,470 or British Patent No. 923,045. Generally, they are arranged preferably such that the sensitivities are decreased toward the support and each nonphotosensitive layer may be placed between the silver halide emulsion layers. As described, for example, in JP-A No. 112751/1982, 200350/1987, 206541/1987, and 206543/1987, a low-sensitive emulsion layer may be placed away from the support and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH stated from the side away from the support.

As described in JP-B No. 34932/1980, an order of a blue-sensitive layer/GH/RH/GL/RL stated from the side away from the support is also possible. Further as described in JP-A Nos. 25738/1981 and 63936/1987, an order of a blue-sensitive layer/GL/RL/GH/RH stated from the side away from the support is also possible.

Further as described in JP-B No. 15495/1974, an arrangement is possible wherein the uppermost layer is a silver halide emulsion layer highest in sensitivity, the intermediate layer is a silver halide emulsion layer lower in sensitivity than that of the uppermost layer, the lower layer is a silver halide emulsion layer further lower in sensitivity than that of the intermediate layer so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity as described in JP-A No. 202464/1984.

Further, for example, an order of a high-sensitive emulsion layer/low-sensitive emulsion layer/medium-sensitive emulsion layer or an order of a low-sensitive emulsion layer/medium-sensitive emulsion layer/high-sensitive emulsion layer can be taken. In the case of four layers or more layers, the arrangement can be varied as above.

As stated above, various layer constitutions and arrangements can be selected in accordance with the purpose of the particular photosensitive material.

In the photographic materials related to the present technique, various additives as described above can be used, and various additives other than them can be also used in accordance with the purpose.

These photographic additives are described in more detail in Research Disclosures Item 17643 (December 1978), Item 18716 (November 1979), and Item 308119 (November 1989) and involved sections are listed in the Table shown below.

| Additive | RD 17643 | RD 18716 | RD 308119 |
|---|---|---|---|
| 1 Chemical sensitizer | p. 23 | p. 648 (right column) | p. 996 |
| 2 Sensitivity-enhancing agent | — | p. 648 (right column) | — |
| 3 Spectral sensitizers and Supersensitizers | pp. 23–24 | pp. 648 (right column) -649 (right column) | pp. 996 (right column) -998 (right column) |
| 4 Brightening agents | p. 24 | p. 647 (right column) | p. 998 (right column) |
| 5 Antifogging agents and Stabilizers | pp. 24–25 | p. 649 (right column) | pp. 998 (right column) -1000 (right column) |
| 6 Light absorbers, Filter dyes, and UV Absorbers | pp. 25–26 | pp. 649 (right column) -650 (left column) | pp. 1003 (left column) -1003 (right column) |
| 7 Stain-preventing agent | p. 25 (right column) | p. 650 (left to right column) | — |
| 8 Image dye stabilizers | p. 25 | — | — |
| 9 Hardeners | p. 26 | p. 651 (left column) | pp. 1004 (right column) -1005 (left column) |
| 10 Binders | p. 26 | p. 651 (left column) | pp. 1003 (right column) -1004 (right column) |
| 11 Plasticizers and Lubricants | p. 29 | p. 650 (right column) | pp. 1006 (left to right) |
| 12 Coating aids and Surface-active agents | pp. 26–27 | p. 650 (right column) | pp. 1005 (left column) -1006 (left column) |
| 13 Antistatic agents | p. 27 | p. 650 (right column) | pp. 1006 (right column) -1007 (left column) |
| 14 Matting agent | — | — | pp. 1008 (left column) -1009 (left column) |

Further, in order to prevent the lowering of photographic properties due to formaldehyde gas, a compound described in, for example, U.S. Pat. Nos. 4,411,987 and 4,435,503 that is able to react with formaldehyde to immobilize is preferably added to the photographic material.

In the present invention, various color couplers can be used, and concrete examples of them are described in patents cited in the above-mentioned *Research Disclosure* No. 17643, VII-C to G, and ibid. No. 307105, VII-C to G.

As yellow couplers, those described in, for example, U.S. Pat. Nos. 3,933,501, 4,022,620, 4,326,024, 4,401,752, and 4,248,961, JP-B No. 10739/1983, British Patent Nos. 1,425,020 and 1,476,760, U.S. Pat. Nos. 3,973,968, 4,314,023, and 4,511,649, and European Patent No. 249,473A are preferable.

As magenta couplers, 5-pyrazolone series and pyrazoloazole series compounds are preferable, and couplers described in, for example, U.S. Pat. Nos. 4,310,619 and 4,351,897, European Patent No. 73,636, U.S. Pat. Nos. 3,061,432 and 3,725,067, *Research Disclosure* No. 24220 (June 1984), JP-A No. 33552/1985, *Research Disclosure* No. 24230 (June 1984), JP-A Nos. 43659/1985, 72238/1986, 35730/1985, 118034/1980, and 185951/1985, U.S. Pat. Nos. 4,500,630, 4,540,654 and 4,556,630, and International Publication No. WO88/04795 are preferable, in particular.

As cyan couplers, phenol series couplers and naphthol series couplers can be mentioned, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent Nos. 121,365A and 249,453A, U.S. Pat. Nos. 3,446,622, 4,333,999, 4,775,616, 4,451,559, 4,427,767, 4,690,889, 4,254,212, and 4,296,199, and JP-A No. 42658/1986 are preferable.

Typical examples of polymerized dye-forming coupler are described in, for example, U.S. Pat. Nos. 3,451,820, 4,080,211, 4,367,282, 4,409,320, and 4,576,910, British Patent No. 2,102,137, and European Patent No. 341,188A.

As a coupler which forms a dye having moderate diffusibility, those described in U.S. Pat. No. 4,366,237, British Patent No. 2,125,570, European Patent No. 96,570, and West German Patent Application (OLS) No. 3,234,533 are preferable.

As a colored coupler to rectify the unnecessary absorption of color-forming dyes, those couplers described in, paragraph VII-G of *Research Disclosure* No. 17643, paragraph VII-G of ibid. No. 307105, U.S. Pat. No. 4,163,670, JP-B No. 39413/1982, U.S. Pat. Nos. 4,004,929 and 4,138,258, and British Patent No. 1,146,368 are preferable. Further, it is preferable to use couplers to rectify the unnecessary absorption of color-forming dyes by a fluorescent dye released upon the coupling reaction as described in U.S. Pat. No. 4,774,181 and couplers having a dye precursor, as a group capable of being released, that can react with the developing agent to form a dye as described in U.S. Pat. No. 4,777,120.

A compound that releases a photographically useful residue accompanied with the coupling reaction can be used favorably in this invention. As a DIR coupler that release a development retarder, those described in patents cited in paragraph VII-F of the above-mentioned *Research Disclosure* No. 17643 and in paragraph VII-F of ibid. No. 307105, JP-A Nos. 151944/1982, 154234/1982, 184248/1985, 37346/1988, and 37350/1986, and U.S. Pat. Nos. 4,248,962 and 4,782,012 are preferable.

As a coupler that releases, imagewisely, a nucleating agent or a development accelerator upon developing, those described in British Patent Nos. 2,097,140 and 2,131,188, and JP-A Nos. 157638/1984 and 170840/1984 are preferable. Further, compounds which release a fogging agent, a developing accelerator, or a solvent for silver halide by a oxidation-reduction reaction with the oxidized product of developing agent as described in JP-A Nos. 107029/1985, 252340/1985, 44940/1989, and 45687/1989 are also preferable.

Other compounds that can be incorporated in the photographic material of the present invention include competitive couplers described in U.S. Pat. No. 4,130,427, multi-equivalent couplers described in U.S. Pat. Nos. 4,283,472, 4,338,393, and 4,310,618, couplers which release a DIR redox compound, couplers which release a DIR coupler, and redox compounds which release a DIR coupler or a DIR redox as described in JP-A Nos. 185950/1985 and 24252/1987, couplers which release a dye to regain a color after releasing as described in European Patent Nos. 173,302A and 313,308A, couplers which release a bleach-accelerating agent as described in *Research Disclosure* No. 11449 and ivid. No. 24241 and JP-A No. 201247/1986, couplers which release a ligand as described in U.S. Pat. No. 4,555,477, couplers which release a leuco dye as described in JP-A No. 75747/1988, and couplers which release a fluorescent dye as described in U.S. Pat. No. 4,774,181.

Couplers utilized in the present invention can be incorporated into a photographic material by various known dispersion methods.

Examples of high-boiling solvent for use in oil-in-water dispersion process are described in, for example, U.S. Pat. No. 2,322,027. As specific examples of high-boiling organic solvent having a boiling point of 175° C. or over at atmospheric pressure for use in oil-in-water dispersion process can be mentioned phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl)phthalate), esters of phosphoric acid or phosphonic acid (e.g., triphenyl phosphate, tricrezyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphate), benzoic esters (e.g., 2-ethylhexyl benzoate, dodecyl benzoate, and 2-ethylhexyl-p-hydroxy benzoate), amides (e.g., N,N-diethyldodecanamide, N,N-diethyllaurylamide, and N-tetradecylpyrrolidone), alcohols or phenols (e.g., isostearyl alcohol and 2,4-di-t-amyl phenol), aliphatic carbonic acid esters (e.g., bis(2-ethylhexyl) sebacate, dioctyl azelate, glycerol tributylate, isostearyl lactate, and trioctyl citrate), aniline derivertives (e.g., N,N-dibutyl-2-butoxy-5-t-octylaniline), and hydrocarbons (e.g., paraffin, dodecyl benzene, and diisopropyl naphthalene). Further, as a co-solvent an organic solvent having a boiling point of about 30° C. or over, preferably a boiling point in the range from 50° C. to about 160° C. can be used, and as typical example can be mentioned ethyl acetate, butyl acetate, ethyl propionate, methylethyl ketone, cyclohexanone, 2-ethoxyethyl acetate, and dimethyl formamide.

Specific examples of process and effects of latex dispersion method, and latices for impregnation are described in, for example, U.S. Pat. No. 4,199,363 and West German Patent Application (OLS) Nos. 2,541,274 and 2,541,230.

In the photographic material of this invention, various antiseptics and antifungal agents, such as phenetyl alcohol, and 1,2-benzisothiazoline-3-one, n-butyl-p-hydroxybenzoate, phenol, 4-chloro-3,5-dimethylphenol, 2-phenoxyethanol, and 2-(4-thiazolyl) bezimidazole as described in JP-A Nos. 257747/1988, 272248/1987, and 80941/1989 are preferably added.

The present invention can be applied to various color photographic materials. As the representative examples, can be mentioned, for example, a color negative film for general purpose and cine-film, a color reversal film for slide or television, a color paper, a color positive film and a color reversal paper.

Suitable supports for use in the present invention are described in, for example, in the above-mentioned *Research Disclosure* No. 17643, page 28, No. 18716, from page 647, right column to page 648, left column and No. 307105, page 879.

In the photographic material of the present invention, preferably the total film thickness of all the hydrophilic colloid layers on the side having emulsion layers is 28 μm or below, more preferably 23 μm or below, further more preferably 18 μm or below, and particularly preferably 16 μm or below. Preferably the film swelling speed $T_{1/2}$ is 30 sec or below, more preferably 20 sec or below. The term "film thickness" means film thickness measured after moisture conditioning at 25° C. and a relative humidity of 55% for two days, and the film swelling speed $T_{1/2}$ can be measured in a manner known in the art. For example, the film swelling speed $T_{1/2}$ can be measured by using a swellometer (swell-measuring meter) of the type described by A. Green et al. in *Photographic Science and Engineering*, Vol. 19, No. 2, pp. 124–129, and $T_{1/2}$ is defined as the time required to reach a film thickness of ½ of the saturated film thickness that is 90% of the maximum swelled film thickness that will be reached when the film is treated with a color developer at 30° C. for 3 min 15 sec.

The film swelling speed $T_{1/2}$ can be adjusted by adding a hardening agent to the gelatin that is a binder or by changing the time conditions after the coating. Preferably the ratio of swelling is 150 to 400%. The ratio of swelling is calculated from the maximum swelled film thickness obtained under the above conditions according to the formula: (Maximum swelled film thickness–film thickness)/Film thickness.

It is preferable that the photographic material of the present invention is provided a hydrophilic layer (designated as a back layer) having a total dried film thickness of 2 μm to 20 μm at the opposite side of having emulsion layers. In such back layer, it is preferable to be contained the above-mentioned light-absorbent, filter-dye, UV-absorbent, static preventer, film-hardening agent, binder, plasticizer, lubricant, coating auxiliary, and surface-active agent. The swelling ratio of back layer is preferably 150 to 500%.

The color photographic material in accordance with the present invention can be subjected to the development processing by an ordinary method as described in the above-mentioned *RD* No. 17643, pp. 28–29, ibid. No. 18716, p. 651, from left column to right column, and ibid. No. 307105, pp. 880–881.

Preferably, the color developer used for the development processing of the photographic material of the present invention is an aqueous alkaline solution whose major component is an aromatic primary amine color-developing agent. As the color-developing agent, aminophenol compounds are useful, though p-phenylene diamine compounds are preferably used, and typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline, and their sulfates, hydrochlorides, and p-toluenesulfonates. Of these, 3-methyl-4-amino-N-ethyl-N-β-hydroxyethylaniline sulfate is particularly preferable. A combination of two or more of these compounds may be used in accordance with the purpose.

The color developer generally contains, for example, buffers, such as carbonates, borates or phosphates of alkali metals, and development inhibitors or antifoggants, such as chloride salt, bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-biscarboxymethylhydrazine, phenylsemicarbazides, triethanolamine, and catecholsulfonic acids, organic solvents such as ethylene glycol and diethylene glycol, development accelerators such as benzyl alcohol, polyethylene glycol, quaternary ammonium salts, and amines, dye forming couplers, competing couplers, auxiliary developers such as 1-phenyl-3-pyrazolidone, tackifiers, and various chelate agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylene-diamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination.

Generally the pH of this color developer and black-and-white developing solution is 9 to 12. The replenishing amount of these developing solutions is generally 3 liter or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in processing tank that is in contact with the air.

The contact area of the photographic processing solution with the air in the processing tank is represented by the opened surface ratio which is defined as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $cm^{-1}$ or less, more preferably 0.001 to 0.05 $cm^{-1}$. Methods for reducing the opened surface ratio that can be mentioned include a utilization of movable lids as described in JP-A No. 82033/1989 and a slit-developing process as described in JP-A No. 216050/1988, besides a method of providing a shutting materials such as floating lids on the surface of photographic processing solution of processing tank. It is preferable to adopt the means for reducing the opened surface ratio not only in a color developing and black-and-white developing process but also in all succeeding processes, such as bleaching, bleach-fixing, fixing, washing, and stabilizing process. It is also possible to reduce the replenishing amount by using means of suppressing the accumulation of bromide ions in the developer.

Although the processing time of color developing is settled, in generally, between 2 and 5 minutes, the time can be shortened by, for example, processing at high temperature and at high pH, and using a color developer having high concentration of color developing agent.

The photographic emulsion layer are generally subjected to a bleaching process after color development. The beaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process may be carried out after the bleach-fixing process. As the bleaching agent, use can be made of, for example, compounds of polyvalent metals, such as iron (III), peracids, quinones, nitro compounds. As typical bleaching agent, use can be made of organic complex salts of iron (III), such as complex salts of aminopolycarboxylic acids, for example ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid, citric acid, tartaric acid, and malic acid. Of these, aminopolycarboxylic acid iron (III) complex salts, including ethylenediaminetetraacetic acid iron (III) complex salts and 1,3-diaminopropanetetraacetic acid iron (III) complex salt are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, by if it is required to quicken the process, the process can be effected at a low pH.

In the bleaching solution, the bleach-fixing solution, and the bath preceding them a bleach-accelerating agent may be used if necessary. Specific examples of useful bleach-accelerating agents are compounds having a mercapto group or a disulfide linkage, described in U.S. Pat. No. 3,893,858, West German Patent Nos. 1,290,812 and 2,059,988, JP-A Nos. 32736/1978, 57831/1978, 37418/1978, 72623/1978, 95630/1978, 95631/1978, 104232/1978, 124424/1978, 141623/1978, and 28426/1978, and *Research Disclosure* No. 17129

(July, 1978); thiazolidine derivatives, described in JP-A No. 140129/1975; thiourea derivatives, described in JP-B No. 8506/1970, JP-A Nos. 20832/1977 and 32735/1978, and U.A. Patent No. 3,706,561; iodide salts, described in West German Patent No. 1,127,715 and JP-A No. 16235/1983; polyoxyethylene compounds in West German Patent Nos. 966,410 and 2,748,430; polyamine compounds, described in JP-B No. 8836/1970; other compounds, described in JP-A Nos. 40943/1974, 59644/1974, 94927/1978, 35727/1979, 26506/1980, and 163940/1983; and bromide ions. Of these, compounds having a mercapto group or a disulfide group are preferable in view of higher acceleration effect, and in particular, compounds described in U.A. Patent No. 3,893,858, West German Patent No. 1,290,812, and JP-A No. 95630/1978 are preferable. Further, compound described in U.S. Pat. No. 4,552,834 are preferable. These bleach-accelerating agents may be added into a photographic material. When the color photographic materials for photographing are to be bleach-fixed, these bleach-accelerating agents are particularly effective.

In addition to the above compounds, preferably the bleaching solution and the bleach-fixing solution contain an organic acid in order to prevent bleach stain. Particularly preferable organic acids are compounds having an acid dissociation constant (pKa) of 2 to 5 and specifically, for example, acetic acid and propionic acid are preferable.

As the fixing agent used in the fixing solution and the bleach-fixing solution, for example, thiosulfates, thiocyanates, thioether compounds, thioureas, and large amount of iodide salts can be mentioned, thiosulfates are generally used, and particularly ammonium thiosulfate can be most widely used. A combination of a thiosulfate with a thiocyanate, a thioether compound, a thiourea, or the like is also preferably used. As the preservative of the fixing solution and the bleach-fixing solution, a sulfite, a bisulfite, a carbonyl-bisulfinic acid adduct, or a sulfinic acid compound described in European Patent No. 294769A is preferable. Further, to the fixing solution and the bleach-fixing solution, various aminopolycarboxylic acids and organic phosphonic acids are preferably added in order to stabilize the solution.

In the present invention, to the fixing solution or the bleach-fixing solution is added preferably a compound having a pKa of 6.0 to 9.0 in order to adjust the pH and preferably imidazoles, such as imidazole, 1-methylimidazole, 1-ethylimidazole, and 2-methylimidazole, are added in an amount of 0.1 to 10 mol/liter.

With respect to the total time of the desilvering step, the shorter the total time is within the range wherein silver retention does not occur, the more preferable it is. Preferably, it is 1 to 3 min, more preferably 1 to 2 min. Further, the processing temperature is 25° to 50° C., preferably 35° to 45° C. In a preferable temperature range, the desilvering speed can be improved and stain can be prevented effectively from occurring after the processing.

In the desilvering step, the stirring is preferably intensified as far as possible. Specific means of intensifying the stirring include a method described in JP-A No. 183460/1987 wherein a jet of a processing solution is struck against the emulsion surface of a photographic material, a method described in JP-A No. 183461/1987 wherein the stirring effect is increased by using a rotating means, a method wherein a photographic material is moved with the emulsion surface in contact with a wiper blade placed in a solution so that the emulsion surface is made turbulent to improve the stirring effect, and a method wherein the circulated amount of the whole of a processing solution is increased. Such a stirring improving means is effective for any of the bleaching solution, the bleach-fixing solution, and the fixing solution. It appears that the improvement in stirring quickens the supply of the bleaching agent and the fixing agent into the emulsion coating and as a result the desilvering speed is increased. The above stirring improving means is effective when a bleach accelerator is used, and the acceleration effect can be increased remarkably or the fixing hindering effect by the bleach accelerator can be removed.

The automatic processor used in processing the photographic material used in the present invention has preferably a photographic material carrying means described in JP-A Nos. 191257/1985, 191258/1985, and 191259/1985. As described in the above JP-A No. 191257/1985, such a conveying means can reduce remarkably the carry-in of the processing solution to a bath from the preceding bath and therefore is high in the effect in preventing the performance of the processing solution from being deteriorated. Such an effect is particularly effective in shortening the processing time in each step and in reducing the replenishing amount of the processing solution.

It is common for the silver halide color photographic material of the present invention to undergo, after a desilvering process such as fixing or bleach-fixing, a washing step and/or a stabilizing step. The amount of washing water may be set within a wide range depending on the characteristics (e.g., due to the materials used, such as couplers), the application of the photographic material, the washing temperature, the number of washing tanks (the number of steps), the type of replenishing system, including, for example, the counter-current system and the direct flow system and other various conditions. Of these, the relationship between the number of water-washing tanks and the amount of washing water in the multi-stage counter current system can be found according to the method described in *Journal of the Society of Motion Picture and Television Engineers,* Vol. 64, pages 248 to 253 (May 1955). According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the color photographic material of the present invention, as a measure to solve this problem the method of reducing calcium ion and magnesium ion described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kagaku,* (1986) published by Sankyo-Shuppan, *Biseibutsu no mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai, can be used.

The pH of the washing water used in processing the photographic material of the present invention is 4 to 9, preferably 5 to 8. The washing water temperature and the washing time to be set may vary depending, for example, on the characteristics and the application of the photographic material, and they are generally selected in the range of 15° to 45° C. for 20 sec to 10 min, and preferably in the range of 25° to 40° C. for 30 sec to 5 min. Further, the photographic material of the present invention can be processed directly with a stabilizing solution instead of the above washing. In such a stabilizing process, any of known processes, described in JP-A Nos. 8543/1982, 14834/1983, and 220345/1985 can be applied.

In some cases, the above washing process is further followed by stabilizing process, and as an example thereof can be mentioned a stabilizing bath that is used as a final bath for color photographic materials for photography, which contains a dye-stabilizing agent and a surface-active agent. As an example of dye-stabilizing agent can be mentioned aldehyde (e.g., formalin and gultalaldehyde), N-methylol compound, hexamethylenetetramine and aldehyde-sulfite adduct. In this stabilizing bath, each kind of the chelating agents and bactericides may be added.

The over-flowed solution due to the replenishing of washing solution and/or stabilizing solution may be reused in other steps, such as a desilvering step.

When each of the above-mentioned processing solutions is concentrated due to the evaporation of water in the processing using an automatic processor, preferably water to correct the concentration is added into each solution.

The silver halide color photographic material of the present invention may contain therein a color-developing agent for the purpose of simplifying and quickening the process. To contain such a color-developing agent, it is preferable to use various precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the silver halide color photographic material of the present invention may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C. Although generally a temperature of 33° to 38° C. may be standard, a higher temperature can be used to accelerate the process to reduce the processing time, or a lower temperature can be used to improve the image quality or the stability of the processing solution.

Further, the silver halide photographic material of the present invention can be adopted to photographic materials for heat development described in, for example, U.S. Pat. No. 4,500,626, JP-A Nos. 133449/1985, 218443/1984, and 238056/1986, and European Patent No. 210,660A2.

When the silver halide photographic material of the present invention is applied to a film unit provided with a lens described in, for example JP-A No. 32615/1990 or Publication of examined Japanese Utility Model Application No. 39784/1991, effects of the present invention are effectively and remarkably attained.

According to the present invention, a silver halide emulsion and a silver halide photographic material high in sensitivity, low in fogging, and improved in the abration-and-pressure resistance can be obtained.

Next, the present invention will be described in detail in accordance with examples, but the invention is not limited to them.

EXAMPLE 1

(1) Preparation of Emulsion

Tabular silver bromide core emulsion 1-A

An aqueous solution of 1200 ml containing 8 g of gelatin and 5 g of KBr was stirred at 60° C., and an aqueous $AgNO_3$ (9.7 g) solution and an aqueous KBr (7 g) solution were added by double jet for 45 sec. (Note: All operations for preparing emulsions in each Example and Comparative Example carried out by controlled double jet process.) After adding further 40 g of gelatin, the temperature was increased to 75° C., followed by ripening for 20 min under presence of $NH_3$. After neutralization with $HNO_3$, an aqueous $AgNO_3$ (130 g) solution and an aqueous KBr solution were added with increasing flow speed (final flow speed was twice flow speed at start) in 80 min. At that time pAg was kept at 8.2. Then, the emulsion was cooled to 35° C., the desalting was effected by an usual flocculation method.

The thus-obtained emulsion was tabular grain having an average diameter corresponding to a circle of 1.3 μm and an average thickness of 0.2 μm.

Tabular silver iodobromide emulsion 1-B (Comparative emulsion)

Emulsion 1-A of corresponding amount to 164 g of $AgNO_3$ was added into 1950 ml of water, and the mixture was kept at 55° C., at pAg of 8.9, and at pH of 5.6. Then, 126 ml of an aqueous KI solution of 0.32M was added quantitatively for 1 min. Subsequently an aqueous $AgNO_3$ (66 g) solution and an aqueous KBr solution were added for 36 min so as to keep pAg at 8.9. Then, the desalting was effected by an usual flocculation method. The thus-obtained emulsion was tabular grain having an average diameter corresponding to a circle of 1.4 μm and an average thickness of 0.25 μm.

In the emulsion, grains having aspect ratio of 3 or more occupied 95% of total projected area, and tabular grains described below were the same.

Tabular silver iodobromide emulsion 1-C (Comparative emulsion)

Emulsion 1-C was prepared in the same manner as Emulsion 1-B, except that a previously prepared silver iodide fine particle emulsion having an average grain size of 0.02 μm and corresponding to $AgNO_3$ was added instead of an aqueous KI solution.

Tabular silver iodobromide emulsion 1-D (Comparative emulsion)

Emulsion 1-D was prepared in the same manner as emulsion 1-B, except that, after 2-iodopropionic acid in equimolar amount of KI was added instead of the aqueous KI solution, an aqueous 0.8 mol sodium sulfite solution (60 ml) was added and pH was raised up to 9.0, followed by maintaining that pH for 8 min and returning the pH to 5.6.

Tabular silver iodobromide emulsion 1-E (Comparative emulsion)

Emulsion 1-E was prepared in the same manner as emulsion 1-D, except that instead of 2-iodopropionic acid an equimolar amount of iodoacetic acid was added.

Tabular silver iodobromide emulsion 1-F (Comparative emulsion)

Emulsion 1-F was prepared in the same manner as emulsion 1-D, except that instead of 2-iodopropionic acid iodocyanomethane in an equimolar amount to KI was added.

Tabular silver iodobromide emulsion 1-G (Emulsion of the present invention)

Emulsion 1-G was prepared in the same manner as emulsion 1-D, except that instead of 2-iodopropionic acid an equimolar amount of Exemplified compound I-3 of the present invention was added.

Tabular silver iodobromide emulsion 1-H (Emulsion of the present invention)

Emulsion 1-H was prepared in the same manner as emulsion 1-D, except that instead of 2-iodopropionic acid an equimolar amount of Exemplified compound I-6 of the present invention was added.

Tabular silver iodobromide emulsion 1-I (Emulsion of the present invention)

Emulsion 1-I was prepared in the same manner as emulsion 1-D, except that instead of 2-iodopropionic acid an equimolar amount of Exemplified compound I-7 of the present invention was added.

Tabular silver iodobromide emulsion 1-J (Emulsion of the present invention)

Emulsion 1-J was prepared in the same manner as emulsion 1-D, except that instead of 2-iodopropionic acid an equimolar amount of Exemplified compound II-1 of the present invention was added.

Tabular silver iodobromide emulsion 1-K (Emulsion of the present invention)

Emulsion 1-K was prepared in the same manner as emulsion 1-D, except that instead of 2-iodopropionic acid an equimolar amount of Exemplified compound II-6 of the present invention was added.

Tabular silver iodobromide emulsion 1-L (Emulsion of the present invention)

Emulsion 1-L was prepared in the same manner as emulsion 1-D, except that instead of 2-iodopropionic acid an equimolar amount of Exemplified compound II-10 of the present invention was added.

(2) Chemical Sensitization

With respect to Emulsion 1-B to 1-L, the gold-and-sulfur sensitization was conducted as follows:

Emulsion was heated to 64° C., $2.6\times10^{-4}$ mol/molAg of sensitizing dye ExS-1, $1.1\times10^{-5}$ mol/molAg of sensitizing dye of ExS-2, and $3.6\times10^{-4}$ mol/molAg of sensitizing dye ExS-3, which sensitizing dyes are shown below, and then potassium thiocyanate, chloroauric acid, and sodium thiosulfate were added, thereby being conducted each chemical sensitization optimumly.

Herein, the term "to conduct chemical sensitization optimumly" means a chemical sensitization wherein highest sensitivity can be obtained by 1/100 sec exposure.

(3) Preparation of Coated Sample and Evaluation Thereof

Coated samples 1 to 11 were prepared by coating respective emulsions and protective layer, shown in Table 1, in a coating amount shown in the following Table A on an undercoated triacetate cellulose film.

TABLE A

| Conditions of emulsion coating | |
|---|---|
| (1) Emulsion layer | |
| Emulsion: various emulsions (silver $3.6\times10^{-2}$ mol/m$^2$) | |
| Coupler: ($1.5\times10^{-3}$ mol/m$^2$) | |

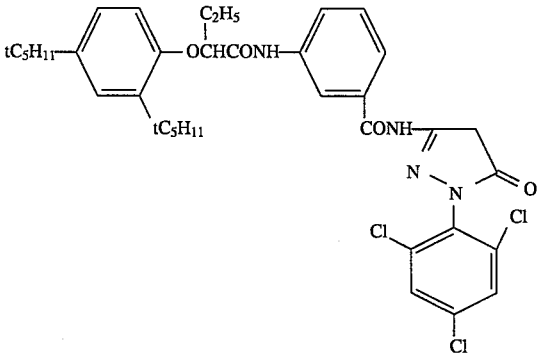

| | |
|---|---|
| Tricrezyl phosphate | (1.10 g/m$^2$) |
| Gelatin | (2.30 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

After let standing these samples for 14 hours under condition of 40° C. and 70% relative humidity, each sample was subjected to exposure to light for 1/100 sec through a continuous wedge and color developing according to Table B shown below.

After processing, the density of each sample through a green filter was measured.

TABLE B

| Process | Processing time | Processing temperature |
|---|---|---|
| Color developing | 2 min 30 sec | 40° C. |
| Bleach-fix | 3 min 0 sec | 40° C. |
| Water washing (1) | 20 sec | 35° C. |
| Water washing (2) | 20 sec | 35° C. |
| Stabilizing | 20 sec | 35° C. |
| Drying | 50 sec | 65° C. |

Compositions of each processing solution are shown below.

| (Color developer) | (gram) |
|---|---|
| Diethylenetriaminepentaacetic acid | 2.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethyl-amino)-2-methylaniline sulfate | 4.5 |
| Water to make | 1.0 liter |
| pH | 10.05 |

| (Bleach-fix solution) | (gram) |
|---|---|
| Iron(III) ammonium ethylenediamine-tetraacetate dihydrate | 90.0 |
| Disodium ethylenediaminetetraacetate | 5.0 |
| Sodium sulfite | 12.0 |
| Ammonium thiosulfite (aqueous 70% solution) | 260.0 ml |
| Acetic acid (98%) | 5.0 ml |
| Bleaching accelerator | 0.01 mol |

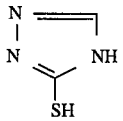

| | |
|---|---|
| Water to make | 1.0 liter |
| pH | 6.0 |

(Washing solution)

Tap water was treated by passing through a mixed bed ion-exchange column filled with H-type strong acidic cation exchange resin (Amberlite IR-120B, tradename, made by Rohm & Haas) and OH-type strong basic anion exchange resin (Amberlite IR-400, the same as the above) so that the concentrations of calcium ions and magnesium ions decrease both 3 mg/l or below, followed by adding 20 mg/l of sodium dichlorinated isocyanurate and 1.5 g/l of sodium sulfate. The pH of this water was in the range of 6.5 to 7.5.

| (Stabilizing solution) | (gram) |
|---|---|
| Formalin (37%) | 2.0 ml |
| Polyoxyethylene-p-monononylphenyl-ether (av. polymerization degree: 10) | 0.3 |
| Disodium ethylenediaminetetraacetate | 0.05 |
| Water to make | 1.0 liter |
| pH | 5.0–8.0 |

The sensitivity was shown as a relative value in logarithm of reciprocal of exposure represented in lux·sec that gives a density of 0.2 over fog.

With respect to the abrasion-and-pressure resistance, test was carried out according to Test Method A shown below. Then each sample was subjected to an exposure for a sensitometry and the color developing according to the process shown in the above Table B.

Test Method A:

After keeping in an atmosphere of 55% relative humidity for 3 hours or more, the emulsion surface of each sample was scratched away by a needle having diameter of 0.1 mm loaded 4 g weight at a speed of 1 cm/sec, in the same atmosphere as above.

With respect to developed samples, densities of a part applied pressure and a part not applied pressure were measured by a measuring slit of 5 μm×1 mm.

The increment of fog due to pressure was indicated by ΔFog. In an exposure range below 100 times exposure $E_0$ that gives a density of fog+0.2, when the density decreases 0.01 or more by applying pressure between exposure $E_1$ and exposure $E_2$, sensitivity decreasing range is indicated by $[(\log E_2-\log E_1)/22]\times 100$ (%).

Results are shown in Table 1.

EXAMPLE 2

Samples 101 to 111 were prepared by multi-coating respective layers having compositions shown below on undercoated triacetate cellulose film support, wherein the fifth layer of each photographic material Emulsion 1-B to 1-L as described in Example 1 was contained, respectively.

Composition of Photosensitive Layer

Main raw materials for use in each layer are classified as follows:

ExC: Cyan coupler
ExM: Magenta coupler
ExY: Yellow coupler
ExS: Sensitizing dye
UV: Ultraviolet-rays absorber
HBS: High-boiling organic solvent
H: Gelatin hardening agent Figures corresponding to respective components are coating amounts represented by g/m$^2$ and figures for silver halide are coating amounts in terms of silver, provided that with respect to sensitizing dye the coating amount is shown in mol per mol of silver halide of the same layer.

TABLE 1

| Sample No. | Emulsion | Supply source of iodide ions | Sensitivity | Fog | Abrasion-and-pressure resistance property ΔFog | Range* | Remarks |
|---|---|---|---|---|---|---|---|
| 1 | 1-B | KI | 100 | 0.39 | 0.10 | 25% | Comparative Example |
| 2 | 1-C | AgI Fine particle (0.02 μm) | 95 | 0.39 | 0.13 | 0% | " |
| 3 | 1-D | $ICH_2CH_2COOH$ | 93 | 0.44 | 0.14 | 0% | " |
| 4 | 1-E | $ICH_2COOH$ | 91 | 0.43 | 0.15 | 0% | " |
| 5 | 1-F | $ICH_2CN$ | 89 | 0.46 | 0.16 | 0% | " |
| 6 | 1-G | 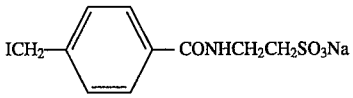 | 126 | 0.33 | 0.08 | 0% | This Invention |
| 7 | 1-H | 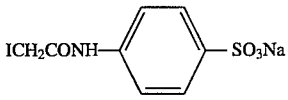 | 138 | 0.29 | 0.06 | 0% | " |
| 8 | 1-I | 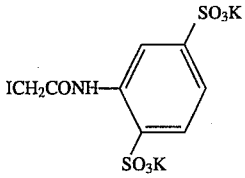 | 132 | 0.30 | 0.07 | 0% | " |
| 9 | 1-J | $ICH_2CONH_2$ | 135 | 0.30 | 0.05 | 0% | " |
| 10 | 1-K | 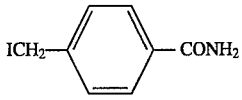 | 129 | 0.32 | 0.04 | 5% | " |
| 11 | 1-L | $ICH_2CH_2SO_2CH_2CONH_2$ | 126 | 0.33 | 0.04 | 5% | " |

Note;
*Range: Sensitivity decreasing range due to pressure

In Table 1, densities of Samples 2 to 11 were shown as relative values assuming the density of Sample 1 being 100.

As is apparent from the results in Table 1, an emulsion low in fog, high in sensitivity, small in the increment of fog due to pressure, and small in decreasing sensitivity due to pressure can be obtained according to the present invention.

(Sample 101 to 111)

First layer (Halation-preventing layer)

-continued (Sample 101 to 111)

| | |
|---|---|
| Black colloidal silver | silver 0.18 |
| Gelatin | 1.40 |
| ExM-1 | 0.18 |
| ExF-1 | $2.0 \times 10^{-3}$ |
| HBS-1 | 0.20 |
| Second layer (Intermediate layer) | |
| Emulsion G | silver 0.065 |
| 2,5-di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| Third layer (Low sensitivity red-sensitive emulsion layer) | |
| Emulsion A | silver 0.25 |
| Emulsion C | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-7 | 0.0050 |
| ExC-8 | 0.010 |
| Cpd-2 | 0.025 |
| HBS-1 | 0.010 |
| Gelatin | 0.87 |
| Fourth layer (Medium sensitivity red-sensitive emulsion layer) | |
| Emulsion D | silver 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.010 |
| Gelatin | 0.75 |
| Fifth layer (High sensitivity red-sensitive emulsion layer) | |
| Emulsion (One of Emulsions 1-B to 1-L) | silver 1.40 |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.10 |
| Gelatin | 1.20 |
| Sixth layer (Intermediate layer) | |
| Cpd-1 | 0.010 |
| HBS-1 | 0.50 |
| Gelatin | 1.10 |
| Seventh layer (Low sensitivity green-sensitive emulsion layer) | |
| Emulsion C | silver 0.35 |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |

-continued (Sample 101 to 111)

| | |
|---|---|
| HBS-1 | 0.30 |
| HBS-3 | 0.010 |
| Gelatin | 0.73 |
| Eighth layer (Medium sensitivity green-sensitive emulsion layer) | |
| Emulsion D | silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |
| Ninth layer (High sensitivity green-sensitive emulsion layer) | |
| Emulsion E | silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |
| Tenth layer (Yellow filter layer) | |
| Yellow colloidal silver | silver 0.030 |
| Cpd-1 | 0.16 |
| HBS-1 | 0.60 |
| Gelatin | 0.60 |
| Eleventh layer (Low sensitivity blue-sensitive emulsion layer) | |
| Emulsion C | silver 0.25 |
| ExS-7 | $8.6 \times 10^{-4}$ |
| ExY-1 | 0.020 |
| ExY-2 | 0.22 |
| ExY-3 | 0.50 |
| ExY-4 | 0.020 |
| HBS-1 | 0.28 |
| Gelatin | 1.10 |
| Twelfth layer (Medium sensitivity blue-sensitive emulsion layer) | |
| Emulsion D | silver 0.40 |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |
| Thirteenth layer (High sensitivity blue-sensitive emulsion layer) | |
| Emulsion F | silver 1.00 |
| ExS-7 | $4.0 \times 10^{-4}$ |
| ExY-2 | 0.10 |
| ExY-3 | 0.10 |
| HBS-1 | 0.070 |
| Gelatin | 0.86 |
| Fourteenth layer (First protective layer) | |
| Emulsion G | silver 0.20 |
| UV-4 | 0.11 |
| UV-5 | 0.17 |
| HBS-1 | $5.0 \times 10^{-2}$ |
| Gelatin | 1.00 |
| Fifteenth layer (Second protective layer) | |
| H-1 | 0.40 |

-continued

| (Sample 101 to 111) | |
|---|---|
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

Further, in order to improve stability, processing property, pressure resistance, keeping property from mold and fungi, antistatic property, and coating property, besides above-mentioned components, W-1 to W-3, B-4 to B-6, F-1 to F-17 and iron salt, lead salt, gold salt, platinum salt, iridium salt, rhodium salt are optionally contained in all emulsion layers.

TABLE 2

| Emulsion | Average AgI content (%) | Average grain diameter (μm) | Deviation coefficient concerning grain diameter (%) | Ratio of diameter/ thickness | Ratio of silver amount [core/ intermediate/ shell] | Ratio of silver amount (AgI content %) | Structures/ features of grains |
|---|---|---|---|---|---|---|---|
| A | 4.0 | 0.45 | 27 | 1 | [1/3] | (13/1) | Double structure octahedral grains |
| B | 8.9 | 0.70 | 14 | 1 | [3/7] | (25/2) | Double structure, octahedral grains |
| C | 2.0 | 0.55 | 25 | 7 | — | — | Uniform structure, tabular grains |
| D | 9.0 | 0.65 | 25 | 6 | [12/59/29] | (0/11/8) | Triple structure, tabular grains |
| E | 9.0 | 0.85 | 23 | 5 | [8/59/33] | (0/11/8) | Triple structure, tabular grains |
| F | 14.5 | 1.25 | 25 | 3 | [37/63] | (34/3) | Double structure, tabular grains |
| G | 1.0 | 0.07 | 15 | 1 | — | — | Uniform structure, fine grains |

In Table 2:

(1) Emulsions A to F were subjected to reduction sensitization using thiourea dioxide and thiosulfonic acid in accordance with Examples given in JP-A No. 191938/1990 when the grains were prepared.

(2) Emulsions A to F were subjected to gold sensitization, sulfur sensitization, and selenium sensitization using in the presence of sodium thiocyanate and spectrally sensitizing dyes stated for the respective photosensitive layers in accordance with Examples given in JP-A No. 237450/1991.

(3) In the preparation of tabular grains, low-molecular weight gelatins were used in accordance with Examples given in JP-A No. 158426/1989.

(4) Rearrangement lines as described in JP-A No. 237450/1991 were observed in the tabular grains under a high-voltage electron microscope.

(5) Emulsions A to F were silver iodobromide.

Compounds added to the layers are shown below.

ExC-1
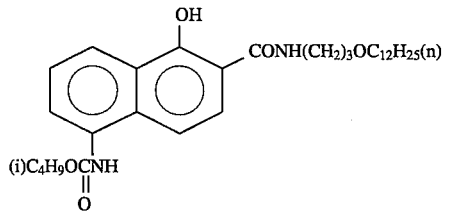
ExC-2
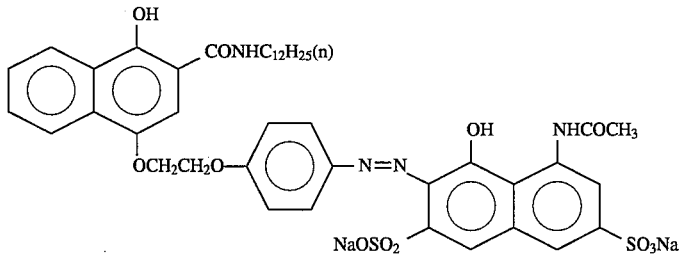
ExC-3
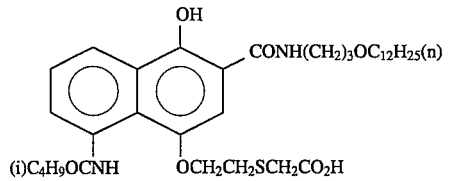
ExC-4
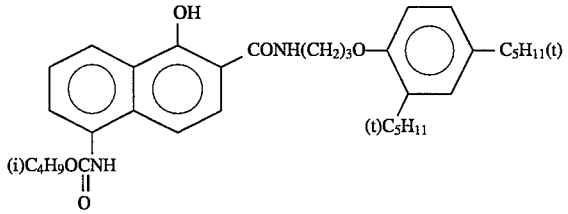
ExC-5
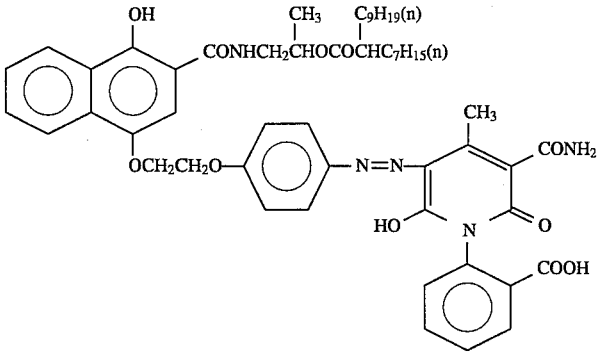
ExC-6
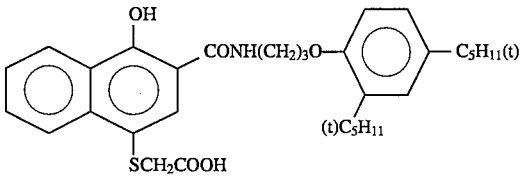

-continued
ExC-7
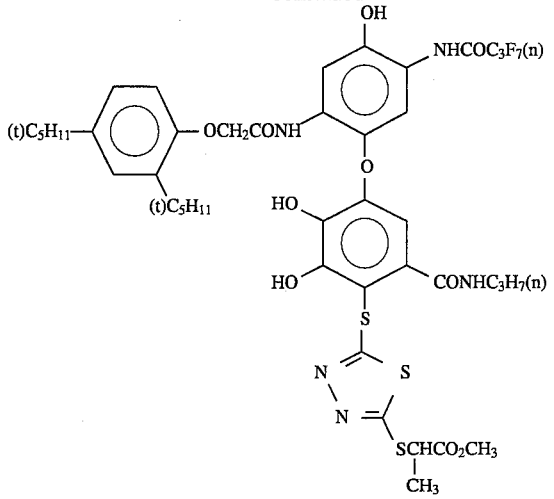
ExC-8
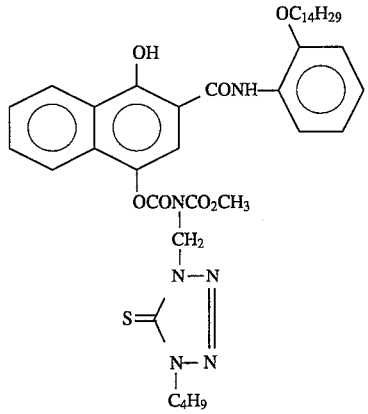
ExM-1
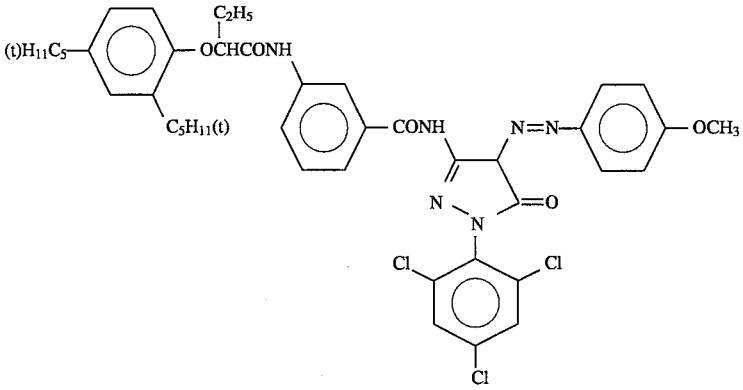
ExM-2
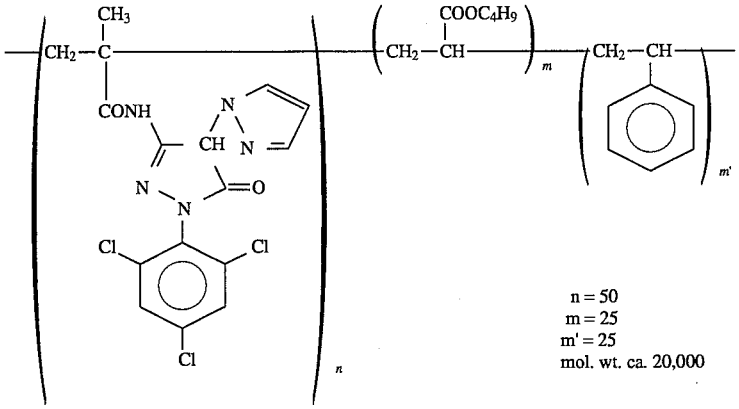

-continued
ExM-3
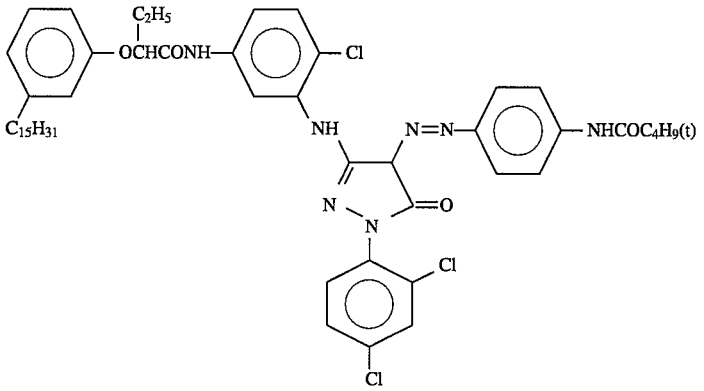
ExM-4
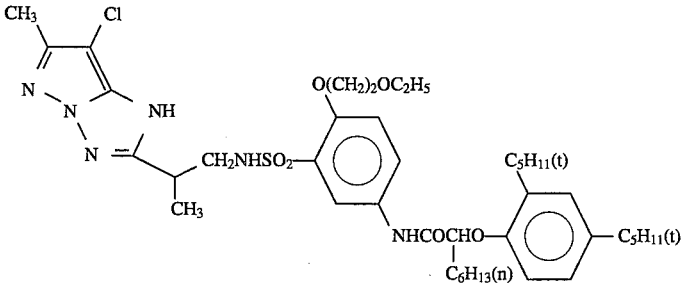
ExM-5
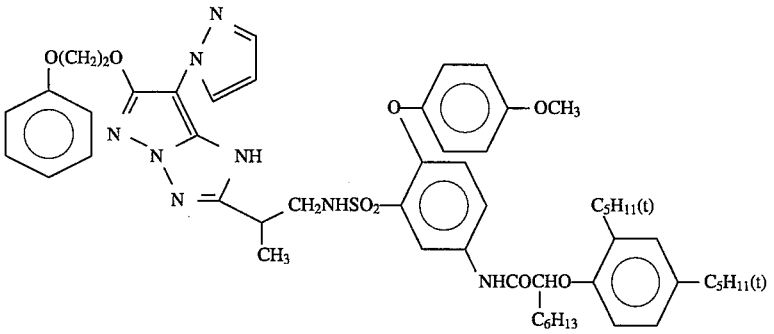
ExY-1
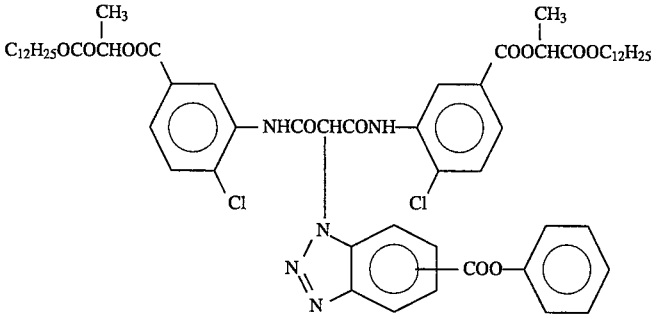
ExY-2
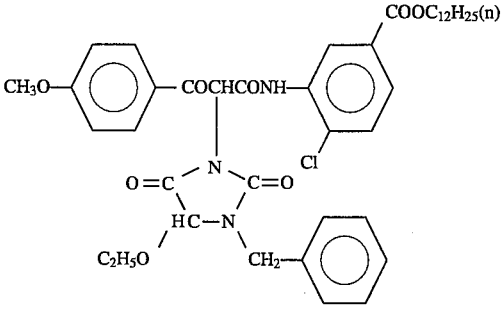
ExY-3
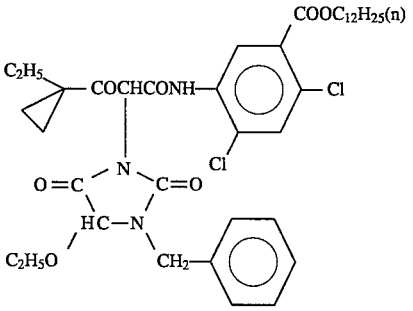

-continued
ExY-4
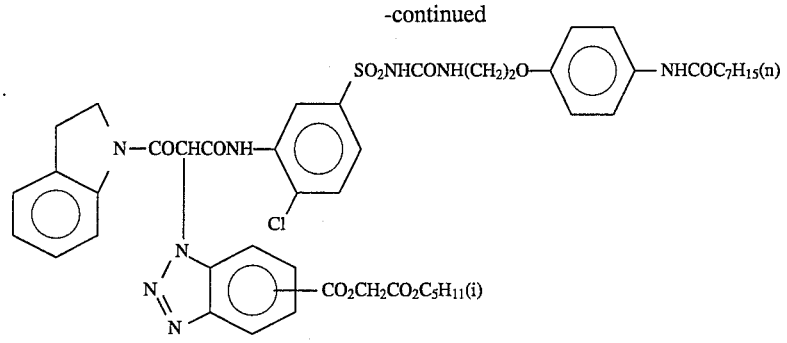
ExF-1
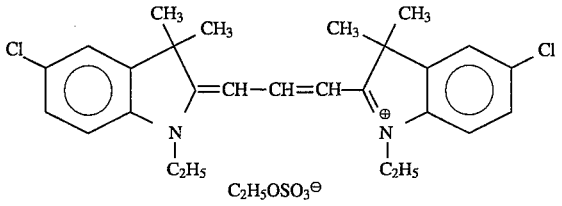
Cpd-1
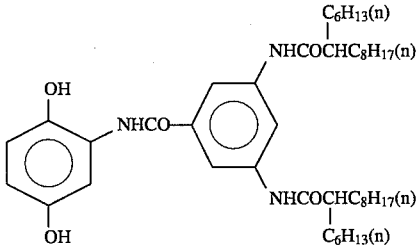
Cpd-2
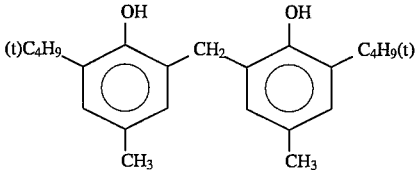
Cpd-3
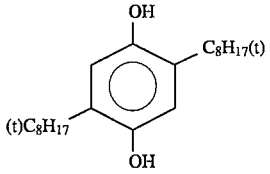
UV-1
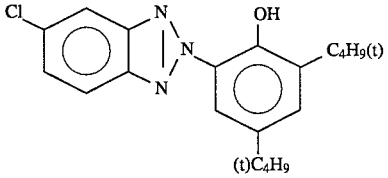
UV-2
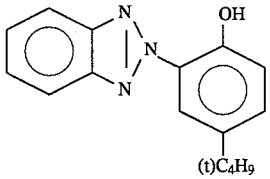
UV-3
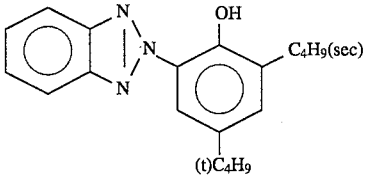
UV-4
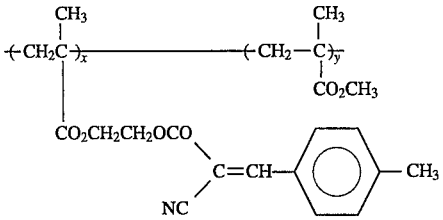
x:y = 70:30 (wt %)
UV-5
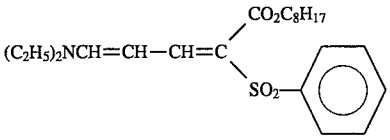
Tricresyl phosphate HBS-1
Di-n-butyl phthalate HBS-2
HBS-3
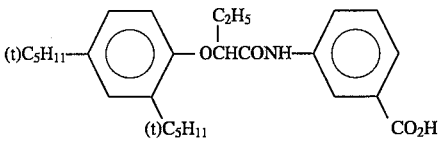
ExS-1
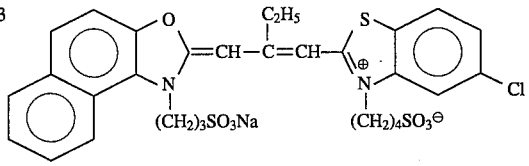

-continued
ExS-2
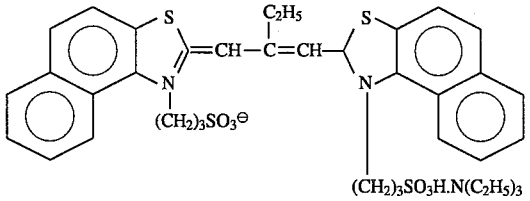
ExS-3
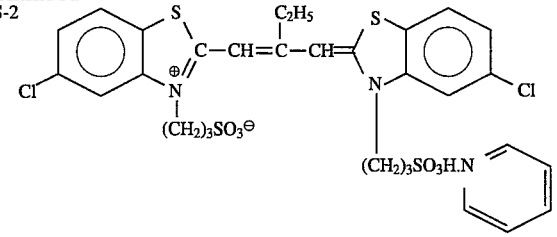
ExS-4
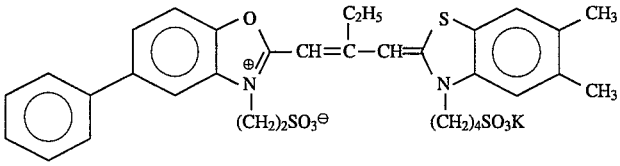
ExS-5
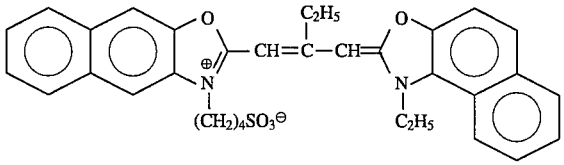
ExS-6
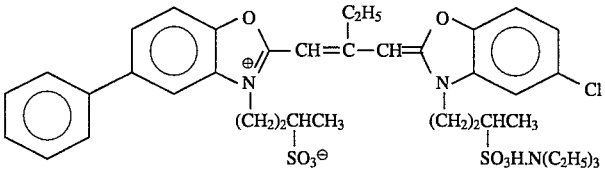
ExS-7
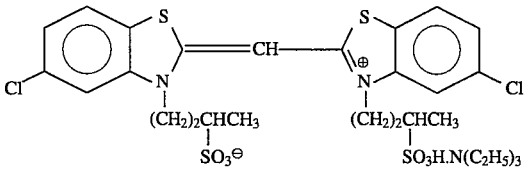
S-1
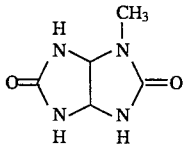
H-1
$CH_2{=}CH{-}SO_2{-}CH_2{-}CONH{-}CH_2$
$CH_2{=}CH{-}SO_2{-}CH_2{-}CONH{-}CH_2$
B-1
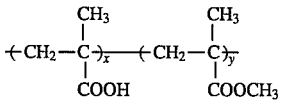
x/y = 10/90
B-2
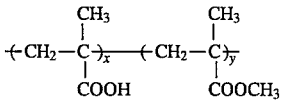
x/y = 40/60
B-3
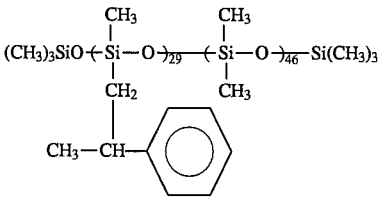
B-4
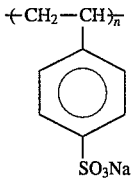
B-5
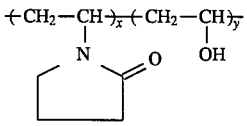
x/y = 70/30
B-6
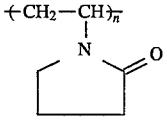
(mol. wt.: ca. 10,000)
W-1
$C_8F_{17}SO_2NHCH_2CH_2CH_2OCH_2CH_2\overset{\oplus}{N}(CH_3)_3$
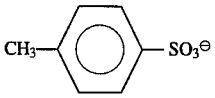

-continued
W-2
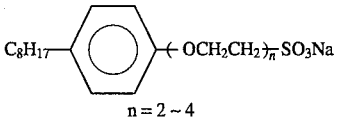
W-3
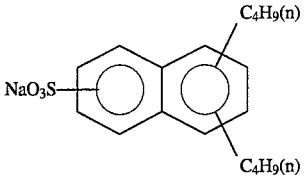
F-1
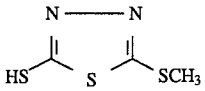
F-2
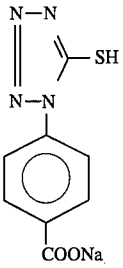
F-3
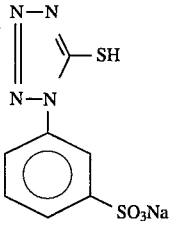
F-4
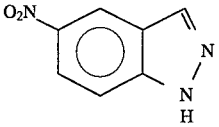
F-5
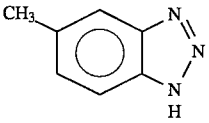
F-6
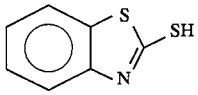
F-7
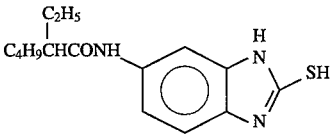
F-8
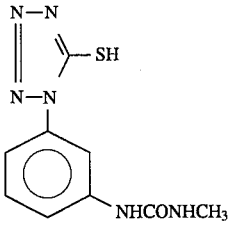
F-9
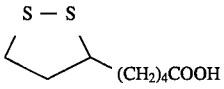
F-10
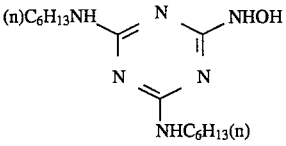
F-11
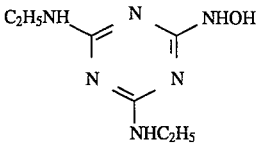
F-12
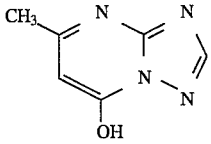
F-13
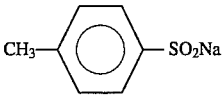
F-14
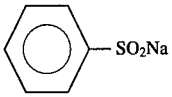
F-15
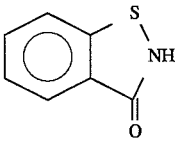
F-16
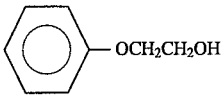

-continued

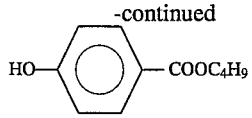

F-17

The thus-obtained Samples 101 to 111 were subjected to an exposure to light and the processing shown in the following Table C.

TABLE C

| Process | Processing time | Processing temperature |
|---|---|---|
| Color developing | 3 min 15 sec | 38° C. |
| Bleaching | 1 min 0 sec | 38° C. |
| Bleach-fix | 3 min 15 sec | 38° C. |
| Water washing (1) | 40 sec | 35° C. |
| Water washing (2) | 1 min 0 sec | 35° C. |
| Stabilizing | 40 sec | 38° C. |
| Drying | 1 min 15 sec | 55° C. |

Compositions of each processing solution are shown below.

| | (gram) |
|---|---|
| (Color developer) | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethyl-amino)-2-methylaniline sulfate | 4.5 |
| Water to make | 1.0 liter |
| pH | 10.05 |
| (Bleaching solution) | |
| Iron(III) ammonium ethylenediamine-tetraacetate dihydrate | 120.0 |
| Disodium ethylenediaminetetraacetate | 10.0 |
| Ammonium bromide | 100.0 |
| Ammonium nitrate | 10.0 |
| Bleaching accelerator $[(CH_3)_2N—CH_2—CH_2—S—]_2.2HCl$ | 0.005 mol |
| Aqueous ammonia (27%) | 15.0 mol |
| Water to make | 1.0 liter |
| pH | 6.3 |
| (Bleach-fix solution) | |
| Iron(III) ammonium ethylenediamine-tetraacetate dehydrate | 50.0 |
| Disodium ethylenediaminetetraacetate | 5.0 |
| Sodium sulfite | 12.0 |
| Ammonium thiosulfite (aqueous 70% solution) | 240.0 ml |
| Aqueous ammonia (27%) | 6.0 ml |
| Water to make | 1.0 liter |
| pH | 7.2 |
| (Washing solution) | |
| Tap water was treated by passing through a mixed bed ion-exchange column filled with H-type strong acidic cation exchange resin (Amberlite IR-120B, tradename, made by Rohm & Haas) and OH-type strong basic anion exchange resin (Amberlite IR-400, the same as the above) so that the concentrations of calcium ions and magnesium ions decrease both 3 mg/l or below, followed by adding 20 mg/l of sodium dichlorinated isocyanurate and 1.5 g/l of sodium sulfate. The pH of this water was in the range of 6.5 to 7.5. | |

-continued

| | (gram) |
|---|---|
| (Stabilizing solution) | |
| Formalin (37%) | 2.0 ml |
| Polyoxyethylene-p-monononylphenyl-ether (av. polymerization degree: 10) | 0.3 |
| Disodium ethylenediaminetetraacetate | 0.05 |
| Water to make | 1.0 liter |
| pH | 5.0–8.0 |

The sensitivity was shown as a relative value in logarithm of reciprocal of exposure that gives a density of 0.2 higher than fog at the characteristics curve of cyan dye.

With respect to the abrasion-and-pressure resistance, test was carried out according to the same Test Method A as Example 1. Then each sample was subjected to the exposure and the color developing in the same manner as in Example 1, and densities at part applied pressure and at part not applied pressure in the characteristics curve of cyan dye were determined, thereby obtaining the increment of fog due to pressure, ΔFog, and sensitivity decreasing range due to pressure.

Results are shown in Table 3.

TABLE 3

| Sample No. | Emulsion | Supply source of iodide ions | Sensitivity | Fog | Abrasion-and-pressure resistance property ΔFog | Range* | Remarks |
|---|---|---|---|---|---|---|---|
| 101 | 1-B | KI | 100 | 0.32 | 0.08 | 25% | Comparative Example |
| 102 | 1-C | AgI Fine particle (0.02 μm) | 95 | 0.33 | 0.11 | 0% | " |
| 103 | 1-D | $ICH_2CH_2COOH$ | 93 | 0.41 | 0.13 | 0% | " |
| 104 | 1-E | $ICH_2COOH$ | 93 | 0.38 | 0.13 | 0% | " |
| 105 | 1-F | $ICH_2CN$ | 87 | 0.43 | 0.14 | 0% | " |
| 106 | 1-G | 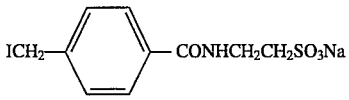 | 123 | 0.31 | 0.07 | 0% | This Invention |
| 107 | 1-H | 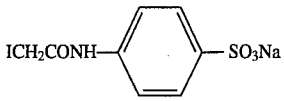 | 135 | 0.31 | 0.06 | 0% | " |
| 108 | 1-I | 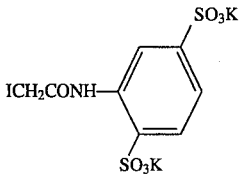 | 132 | 0.27 | 0.05 | 0% | " |
| 109 | 1-J | $ICH_2CONH_2$ | 132 | 0.28 | 0.06 | 0% | " |
| 110 | 1-K | 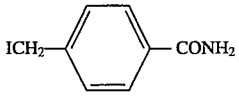 | 126 | 0.30 | 0.05 | 5% | " |
| 111 | 1-L | $ICH_2CH_2SO_2CH_2CONH_2$ | 123 | 0.31 | 0.05 | 5% | " |

Note;
*Range: Sensitivity decreasing range due to pressure

As is apparent from the results in Table 3, as same as those of Example 1, emulsion according to the present invention is low in fog, high in sensitivity, and improved in the abrasion-and-pressure resistance, thereby showing remarkable effects of the invention.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for forming silver halide grains, which comprises introducing into 50 to 100% of the total number of silver halide grains 10 or more dislocation lines onto fringes of said silver halide grains by using at least one iodide-ion-releasing compound represented by the following formula (I) or (II):

$$I—L—SO_3^-M^+ \qquad \text{formula (I)}$$

wherein L represents a divalent organic group, and $M^+$ represents a hydrogen ion or a monovalent cation,

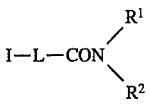

formula (II)

wherein L represents a divalent organic group, and $R^1$ and $R^2$ each independently represents a hydrogen atom, an alkyl group, an aralkyl group, or an aryl group, or $R^1$ and $R^2$ bond together to form a ring.

2. The method for forming silver halide grains as claimed in claim 1, wherein the iodide-ion-releasing compound is selected from a compound of formula (I).

3. The method for forming silver halide grains as claimed in claim 1, wherein the iodide-ion-releasing compound is selected from a compound of formula (II).

4. The method for forming silver halide grains as claimed in claim 1, wherein the silver halide grains contain silver iodide and have a high-silver-iodide region therein, the region's silver iodide content is higher than the average silver iodide content of the whole silver halide grain, and the high-silver-iodide region is formed by using an iodide-ion-releasing compound represented by the above formula (I) or (II).

5. The method for forming silver halide grains as claimed in claim 1, wherein the iodide-ion-releasing compound is used in the presence of an iodide-ion-release regulator.

6. The method for forming silver halide grains as claimed in claim 5, wherein the iodide-ion-release regulator is selected from a group consisting of a base and a nucleophilic reagent.

7. The method for forming silver halide grains as claimed in claim 5, wherein the iodide-ion-release regulator is used at a concentration in the range from $1\times10^{-7}$ to 20M.

8. The method for forming silver halide grains as claimed in claim 1, wherein silver halide grains are formed whose deviation coefficient of the silver iodide content distribution is 3 to 20%.

9. The method for forming silver halide grains as claimed in claim 1, wherein the divalent organic group represented by L in formula (I) or (II) is selected from the group consisting of an aliphatic group, an aromatic group, a heterocyclic group, a combination thereof, and a group formed by combining the aliphatic group, the aromatic group, or the heterocyclic groups with —O—, —N(R)—, —CO—, —CS—, —S—, —SO—, —$SO_2$—, —P(R)—, or —PO(R)—, in which R represents a hydrogen atom or a monovalent group.

10. The method for forming silver halide grains as claimed in claim 1, wherein the divalent organic group represented by L in formula (I) or (II) is selected from the group consisting of a saturated or unsaturated straight-chain, branched-chain, or cyclic alkylene group having 1 to 30 carbon atoms, a monocyclic or bicyclic aryl group which is condensed or not condensed with another heterocyclic group, and a saturated or unsaturated 5- or 6-membered heterocycic ring containing one or more N, O, P, S, and Se.

11. The method for forming silver halide grains as claimed in claim 1, wherein the iodine atom represented by I in formula (I) or (II) is bonded to a carbon atom of the divalent organic group represented by L in formula (I) or (II).

12. The method for forming silver halide grains as claimed in claim 1, wherein the cation represented by $M^+$ in formula (I) is selected from the group consisting of a hydrogen atom, an ammonium ion, an alkali metal ion, and another metal ion.

13. The method for forming silver halide grains as claimed in claim 1, wherein $R^1$ and $R^2$ in formula (II) is selected from the group consisting of a hydrogen atom, a straight-chain, branched-chain, or cyclic alkyl group having 1 to 20 carbon atoms, an aralkyl group having 7 to 20 carbon atoms, and an aryl group having 6 to 20 carbon atoms.

14. The method for forming silver halide grains as claimed in claim 1, wherein the iodide-ion-releasing compound represented by formula (I) or (II) is used at a concentration in a range from $1\times10^{-7}$ to 20M.

15. The method for forming silver halide grains as claimed in claim 1, wherein the iodide-ion-releasing compound represented by formula (I) or (II) is used at a temperature in a range from 30° to 80° C.

16. The method for forming silver halide grains as claimed in claim 1, wherein said silver halide grains are tabular grains.

17. The method for forming silver halide grains as claimed in claim 1, wherein $R^1$ is a hydrogen atom and $R^2$ is an alkyl group, an aralkyl group, or an aryl group.

18. The method for forming silver halide grains as claimed in claim 17, wherein the $R^2$ group is substituted with an alkyl group.

19. The method for forming silver halide grains as claimed in claim 18, wherein $R^2$ is 2-ethylhexyl.

20. The method for forming silver halide grains as claimed in claim 1, wherein $R^1$ or $R^2$ is an alkyl group, an aralkyl group or an aryl group which is substituted with an alkyl group, an aralkyl group, an alkenyl group, an alkynyl group, an alkoxy group, an aryl group, an amino group, a ureido group, a urethane group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group, or an imido group.

21. A method for producing a silver halide photographic material, which comprises forming into 50 to 100% of the total number of silver halide grains 10 or more dislocation lines onto fringes of said grains in the presence of at least one iodide-ion-releasing compound represented by the following formula (I) or (II) and coating an emulsion containing the silver halide grains as at least one silver halide emulsion layer on a support:

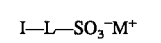

formula (I)

wherein L represents a divalent organic group and $M^+$ represents a hydrogen ion or a monovalent cation,

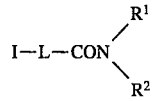

formula (II)

wherein L represents a divalent organic group, and $R^1$ and $R_2$ each independently represents a hydrogen atom, an alkyl group, an aralkyl group, or an aryl group, or $R^1$ and $R^2$ bond together to form a ring.

22. The method for producing a silver halide photographic material as claimed in claim 21, wherein silver halide grains are formed in the presence of at least one iodide-ion-releasing compound represented by formula (I) .

23. The method for producing a silver halide photographic material as claimed in claim 21, wherein silver halide grains are formed in the presence of at least one iodide-ion-releasing compound represented by formula (II).

24. The method for producing a silver halide photographic material as claimed in claim 21, wherein the silver halide grains are tabular grains.

25. The method for producing a silver halide photographic material according to claim 21, wherein $R^1$ or $R^2$ is an alkyl group, an aralkyl group or an aryl group which is substituted with an alkyl group having 1 to 20 carbon atoms, an aralkyl group having 7 to 30 carbon atoms, an alkoxy group having 1 to 20 carbon atoms, an amino group substituted by an alkyl group having 1 to 20 carbon atoms, an acylamino group having 2 to 30 carbon atoms, a sulfonamido group having 1 to 30 carbon atoms, a ureido group having 1 to 30 carbon atoms, or a phosphoric acid amido group having 1 to 30 carbon atoms.

* * * * *